US010289037B2

(12) United States Patent
Seki et al.

(10) Patent No.: US 10,289,037 B2
(45) Date of Patent: May 14, 2019

(54) FIXING DEVICE AND IMAGE FORMING APPARATUS

(71) Applicants: Takayuki Seki, Kanagawa (JP); Takashi Seto, Kanagawa (JP); Kenji Ishii, Kanagawa (JP); Hiroshi Yoshinaga, Chiba (JP); Ippei Fujimoto, Kanagawa (JP); Kazunari Sawada, Shizuoka (JP); Hiroyuki Shimada, Tokyo (JP)

(72) Inventors: Takayuki Seki, Kanagawa (JP); Takashi Seto, Kanagawa (JP); Kenji Ishii, Kanagawa (JP); Hiroshi Yoshinaga, Chiba (JP); Ippei Fujimoto, Kanagawa (JP); Kazunari Sawada, Shizuoka (JP); Hiroyuki Shimada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/827,085

(22) Filed: Nov. 30, 2017

(65) Prior Publication Data

US 2018/0173138 A1 Jun. 21, 2018

(30) Foreign Application Priority Data

Dec. 16, 2016 (JP) ..... 2016-244813

(51) Int. Cl.
*G03G 15/20* (2006.01)
*G03G 15/01* (2006.01)
*G03G 15/00* (2006.01)

(52) U.S. Cl.
CPC ..... *G03G 15/2017* (2013.01); *G03G 15/2053* (2013.01); *G03G 15/2064* (2013.01);
(Continued)

(58) Field of Classification Search
CPC ..... G03G 15/2017; G03G 15/2053; G03G 15/2064; G03G 15/0189; G03G 15/5004; G03G 15/80; G03G 2215/2035
See application file for complete search history.

(56) References Cited

U.S. PATENT DOCUMENTS 4,592,651 A 6/1986 Oikawa et al.
4,640,611 A 2/1987 Ohdake et al.
(Continued)

FOREIGN PATENT DOCUMENTS

JP 2006-078965 3/2006
JP 2007-310220 11/2007
(Continued)

OTHER PUBLICATIONS

U.S. Appl. No. 15/604,294, filed May 24, 2017, Takayuki Seki, et al.
(Continued)

*Primary Examiner* — Joseph S Wong
(74) *Attorney, Agent, or Firm* — Oblon, McClelland, Maier & Neustadt, L.L.P.

(57) ABSTRACT

A fixing device includes a lateral end heater, disposed opposite a lateral end of an inner circumferential surface of a fixing rotator in an axial direction thereof, to heat the fixing rotator and a thermal conduction aid contacting the fixing rotator and the lateral end heater to conduct heat. The lateral end heater includes a power supply portion disposed outboard from a lateral end of the thermal conduction aid in a longitudinal direction thereof and disposed opposite the inner circumferential surface of the fixing rotator. The power supply portion includes an electrode. A cover covers the power supply portion and includes a cover face disposed opposite the inner circumferential surface of the fixing rotator. A height adjuster adjusts a height of the cover face of the cover and causes the cover face to define an identical
(Continued)

plane with a fixing rotator side face of the thermal conduction aid.

14 Claims, 10 Drawing Sheets

(52) U.S. Cl.
CPC ..... *G03G 15/0189* (2013.01); *G03G 15/5004* (2013.01); *G03G 15/80* (2013.01); *G03G 2215/2035* (2013.01)

(56) References Cited

U.S. PATENT DOCUMENTS

| | | | | |
|---|---|---|---|---|
| 5,060,012 | A | 10/1991 | Seto et al. | |
| 5,263,698 | A | 11/1993 | Higuchi et al. | |
| 5,521,679 | A | 5/1996 | Miyakawa et al. | |
| 5,541,712 | A | 7/1996 | Fujitaka et al. | |
| 5,625,442 | A | 4/1997 | Seki | |
| 5,749,037 | A | 5/1998 | Seki | |
| 2006/0257183 | A1 | 11/2006 | Ehara et al. | |
| 2012/0177388 | A1 | 7/2012 | Imada et al. | |
| 2013/0114967 | A1* | 5/2013 | Arimoto | G03G 15/205 399/70 |
| 2014/0079453 | A1 | 3/2014 | Arai et al. | |
| 2015/0261157 | A1 | 9/2015 | Yamano et al. | |
| 2016/0004197 | A1 | 1/2016 | Imada et al. | |
| 2016/0098003 | A1 | 4/2016 | Uchitani et al. | |
| 2016/0147185 | A1 | 5/2016 | Hase et al. | |
| 2016/0161890 | A1 | 6/2016 | Shoji et al. | |
| 2016/0187823 | A1* | 6/2016 | Seto | G03G 15/2053 399/329 |
| 2016/0223961 | A1* | 8/2016 | Takagi | G03G 15/2053 |
| 2016/0223963 | A1 | 8/2016 | Yoshinaga et al. | |
| 2016/0231672 | A1 | 8/2016 | Seto et al. | |
| 2016/0238975 | A1 | 8/2016 | Seki et al. | |
| 2016/0246228 | A1 | 8/2016 | Fujimoto et al. | |
| 2016/0274510 | A1 | 9/2016 | Hase et al. | |
| 2016/0274511 | A1 | 9/2016 | Ogino et al. | |
| 2016/0274514 | A1 | 9/2016 | Ishii et al. | |
| 2016/0327891 | A1 | 11/2016 | Ikebuchi et al. | |
| 2016/0334742 | A1 | 11/2016 | Kobashigawa et al. | |
| 2016/0378027 | A1 | 12/2016 | Sawada et al. | |
| 2017/0003633 | A1 | 1/2017 | Hase et al. | |
| 2017/0010570 | A1 | 1/2017 | Fujimoto et al. | |
| 2017/0102652 | A1 | 4/2017 | Imada et al. | |
| 2017/0123357 | A1 | 5/2017 | Shimada et al. | |
| 2017/0176899 | A1 | 6/2017 | Okamoto et al. | |
| 2017/0176906 | A1 | 6/2017 | Sawada et al. | |
| 2017/0176907 | A1 | 6/2017 | Sawada et al. | |
| 2017/0185009 | A1 | 6/2017 | Yoshinaga et al. | |
| 2017/0185015 | A1 | 6/2017 | Yoshinaga et al. | |
| 2017/0185020 | A1 | 6/2017 | Seki et al. | |
| 2017/0185021 | A1 | 6/2017 | Seki et al. | |
| 2017/0255147 | A1 | 9/2017 | Seki et al. | |
| 2017/0261900 | A1 | 9/2017 | Sawada et al. | |
| 2017/0285542 | A1 | 10/2017 | Hase et al. | |

FOREIGN PATENT DOCUMENTS

| | | |
|---|---|---|
| JP | 2010-078839 | 4/2010 |
| JP | 2011-033939 | 2/2011 |
| JP | 2014-056146 | 3/2014 |
| JP | 2014-056203 | 3/2014 |
| JP | 2015-194661 | 11/2015 |
| JP | 2016-145961 | 8/2016 |

OTHER PUBLICATIONS

U.S. Appl. No. 15/627,693, filed Jun. 20, 2017, Hiroshi Yoshinaga, et al.
U.S. Appl. No. 15/627,704, filed Jun. 20, 2017, Kazunari Sawada, et al.

* cited by examiner

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2016-244813, filed on Dec. 16, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one embodiment, the fixing device includes a fixing rotator that is endless, flexible, and rotatable in a rotation direction. An opposed rotator is disposed opposite an outer circumferential surface of the fixing rotator. A lateral end heater, which is disposed opposite a lateral end of an inner circumferential surface of the fixing rotator in an axial direction of the fixing rotator, heats the fixing rotator. A thermal conduction aid, which contacts the fixing rotator and the lateral end heater, conducts heat in the axial direction of the fixing rotator. The thermal conduction aid includes a fixing rotator side face disposed opposite the inner circumferential surface of the fixing rotator. The lateral end heater includes a power supply portion disposed outboard from a lateral end of the thermal conduction aid in a longitudinal direction of the thermal conduction aid and disposed opposite the inner circumferential surface of the fixing rotator. The power supply portion includes an electrode. A cover covers the power supply portion and includes a cover face disposed opposite the inner circumferential surface of the fixing rotator. A height adjuster adjusts a height of the cover face of the cover. The height adjuster causes the cover face to define an identical plane with the fixing rotator side face of the thermal conduction aid.

This specification further describes an improved fixing device. In one embodiment, the fixing device includes a fixing rotator that is endless, flexible, and rotatable in a rotation direction. An opposed rotator is disposed opposite an outer circumferential surface of the fixing rotator. A lateral end heater, which is disposed opposite a lateral end of an inner circumferential surface of the fixing rotator in an axial direction of the fixing rotator, heats the fixing rotator. A thermal conduction aid, which contacts the lateral end heater and the fixing rotator, conducts heat in the axial direction of the fixing rotator. The thermal conduction aid includes a fixing rotator side face disposed opposite the inner circumferential surface of the fixing rotator. The lateral end heater includes a power supply portion disposed outboard from a lateral end of the thermal conduction aid in a longitudinal direction of the thermal conduction aid and disposed opposite the inner circumferential surface of the fixing rotator. The power supply portion includes an electrode. A cover covers the power supply portion. The cover includes a cover face disposed opposite the inner circumferential surface of the fixing rotator. A height adjuster adjusts a height of the cover face of the cover. The height adjuster causes the cover face to project beyond the fixing rotator side face of the thermal conduction aid.

This specification further describes an improved image forming apparatus. In one embodiment, the image forming apparatus includes an image bearer to bear a toner image and a fixing device to fix the toner image on a recording medium. The fixing device includes a fixing rotator that is endless, flexible, and rotatable in a rotation direction. An opposed rotator is disposed opposite an outer circumferential surface of the fixing rotator. A lateral end heater, which is disposed opposite a lateral end of an inner circumferential surface of the fixing rotator in an axial direction of the fixing rotator, heats the fixing rotator. A thermal conduction aid, which contacts the fixing rotator and the lateral end heater, conducts heat in the axial direction of the fixing rotator. The thermal conduction aid includes a fixing rotator side face disposed opposite the inner circumferential surface of the fixing rotator. The lateral end heater includes a power supply portion disposed outboard from a lateral end of the thermal conduction aid in a longitudinal direction of the thermal conduction aid and disposed opposite the inner circumferential surface of the fixing rotator. The power supply portion includes an electrode. A cover covers the power supply portion and includes a cover face disposed opposite the inner circumferential surface of the fixing rotator. A height adjuster adjusts a height of the cover face of the cover. The height adjuster causes the cover face to define an identical plane with the fixing rotator side face of the thermal conduction aid.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
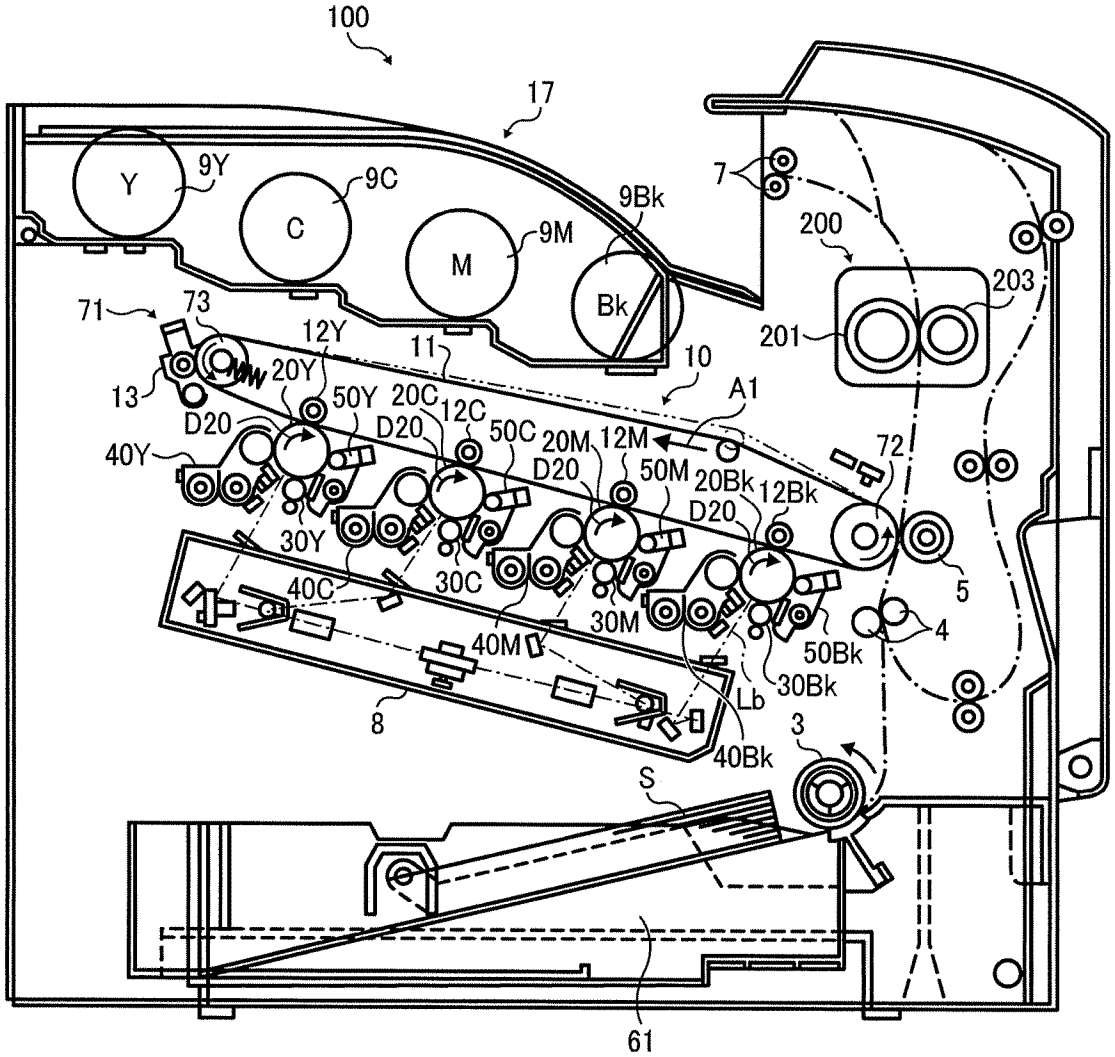
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 according to an embodiment is explained.

FIG. 1 is a schematic vertical cross-sectional view of the image forming apparatus 100. The image forming apparatus 100 may be a copier, a facsimile machine, a printer, a multifunction peripheral or a multifunction printer (MFP) having at least two of copying, printing, scanning, facsimile, and plotter functions, or the like. According to this embodiment, the image forming apparatus 100 is a color printer that forms a color toner image on a recording medium by electrophotography. Alternatively, the image forming apparatus 100 may be a monochrome printer that forms a monochrome toner image on a recording medium.

Referring to FIG. 1, a description is provided of a construction of the image forming apparatus 100.

In the drawings for explaining embodiments of this disclosure, for fixing devices and image forming apparatuses to which the embodiments are applicable, identical reference numerals are assigned, as long as discrimination is possible, to components such as members and component parts having an identical function or shape, thus omitting description thereof once it is provided.

The image foil ling apparatus 100 is a color printer employing a tandem system in which a plurality of image forming devices for forming toner images in a plurality of colors, respectively, is aligned in a rotation direction of an intermediate transfer belt. The image forming apparatus 100 includes four photoconductive drums 20Y, 20C, 20M, and 20Bk serving as image bearers that bear yellow, cyan, magenta, and black toner images in separation colors, respectively, that is, yellow, cyan, magenta, and black.

The yellow, cyan, magenta, and black toner images formed on the photoconductive drums 20Y, 20C, 20M, and 20Bk as visible images, respectively, are primarily transferred successively onto an intermediate transfer belt 11 serving as an intermediate transferor disposed opposite the photoconductive drums 20Y, 20C, 20M, and 20Bk as the intermediate transfer belt 11 rotates in a rotation direction A1 such that the yellow, cyan, magenta, and black toner images are superimposed on a same position on the intermediate transfer belt 11 in a primary transfer process. Thereafter, the yellow, cyan, magenta, and black toner images superimposed on the intermediate transfer belt 11 are secondarily transferred onto a sheet S serving as a recording medium collectively in a secondary transfer process.

Each of the photoconductive drums 20Y, 20C, 20M, and 20Bk is surrounded by image forming components that form the yellow, cyan, magenta, and black toner images on the photoconductive drums 20Y, 20C, 20M, and 20Bk as the photoconductive drums 20Y, 20C, 20M, and 20Bk rotate clockwise in FIG. 1 in a rotation direction D20.

Taking the photoconductive drum 20Bk that forms the black toner image, the following describes a construction of components that form the black toner image.

The photoconductive drum 20Bk is surrounded by a charger 30Bk, a developing device 40Bk, a primary transfer roller 12Bk, and a cleaner 50Bk in this order in the rotation direction D20 of the photoconductive drum 20Bk. Similarly, the photoconductive drums 20Y, 20C, and 20M are surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively.

The charger 30Bk uniformly changes an outer circumferential surface of the photoconductive drum 20Bk. An optical writing device 8 optically writes an electrostatic latent image on the charged outer circumferential surface of the photoconductive drum 20Bk with a laser beam Lb according to image data sent from an external device such as a client computer. The developing device 40Bk visualizes the electrostatic latent image as a black toner image.

As the intermediate transfer belt 11 rotates in the rotation direction A1, the yellow, cyan, magenta, and black toner images formed on the photoconductive drums 20Y, 20C, 20M, and 20Bk, respectively, are primarily transferred successively onto the intermediate transfer belt 11, thus being superimposed on the same position on the intermediate transfer belt 11 and formed into a color toner image. In the primary transfer process, the primary transfer rollers 12Y, 12C, 12M, and 12Bk disposed opposite the photoconductive drums 20Y, 20C, 20M, and 20Bk via the intermediate transfer belt 11, respectively, apply a voltage, that is, a primary transfer bias, to the photoconductive drums 20Y, 20C, 20M, and 20Bk successively from the upstream photoconductive drum 20Y to the downstream photoconductive drum 20Bk in the rotation direction A1 of the intermediate transfer belt 11.

The photoconductive drums 20Y, 20C, 20M, and 20Bk are aligned in this order in the rotation direction A1 of the intermediate transfer belt 11. The photoconductive drums 20Y, 20C, 20M, and 20Bk are located in four image forming stations that form the yellow, cyan, magenta, and black toner images, respectively.

The image forming apparatus 100 includes the four image forming stations that form the yellow, cyan, magenta, and black toner images, respectively, an intermediate transfer belt unit 10, a secondary transfer roller 5, an intermediate transfer belt cleaner 13, and the optical writing device 8. The intermediate transfer belt unit 10 is situated above and disposed opposite the photoconductive drums 20Y, 20C, 20M, and 20Bk. The intermediate transfer belt unit 10 incorporates the intermediate transfer belt 11 and the primary transfer rollers 12Y, 12C, 12M, and 12Bk.

The secondary transfer roller 5 serves as a secondary transferor disposed opposite the intermediate transfer belt 11 and driven and rotated in accordance with rotation of the intermediate transfer belt 11. The intermediate transfer belt cleaner 13 is disposed opposite the intermediate transfer belt 11 to clean the intermediate transfer belt 11. The optical writing device 8 is situated below and disposed opposite the four image forming stations.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20Bk thereto, forming electrostatic latent images on the photoconductive drums 20Y, 20C, 20M, and 20Bk, respectively. FIG. 1 illustrates the light beam Lb irradiating the photoconductive drum 20Bk. Similarly, light beams irradiate the photoconductive drums 20Y, 20C, and 20M, respectively.

The image forming apparatus 100 further includes a sheet feeder 61 and a registration roller pair 4. The sheet feeder 61, disposed in a lower portion of the image forming apparatus 100, incorporates a paper tray that loads a plurality of sheets S to be conveyed to a secondary transfer nip formed between the intermediate transfer belt 11 and the secondary transfer roller 5. The sheet feeder 61 includes a feed roller 3 that contacts an upper side of an uppermost sheet S of the plurality of sheets S loaded on the paper tray of the sheet feeder 61. As the feed roller 3 is driven and rotated counterclockwise in FIG. 1, the feed roller 3 feeds the uppermost sheet S to the registration roller pair 4.

The registration roller pair 4 resumes rotation to convey the sheet S conveyed from the sheet feeder 61 to the secondary transfer nip formed between the intermediate transfer belt 11 and the secondary transfer roller 5 at a predetermined time when the yellow, cyan, magenta, and black toner images superimposed on the intermediate transfer belt 11 reach the secondary transfer nip. The image forming apparatus 100 further includes a sensor for detecting that a leading edge of the sheet S reaches the registration roller pair 4.

The secondary transfer roller 5 secondarily transfers the color toner image formed on the intermediate transfer belt 11 onto the sheet S as the sheet S is conveyed through the secondary transfer nip. The sheet S bearing the color toner image is conveyed to a fixing device 200 where the color toner image is fixed on the sheet S under heat and pressure. An output roller pair 7 ejects the sheet S bearing the fixed color toner image onto an output tray 17 disposed atop the image forming apparatus 100. The output tray 17 stacks the sheet S.

In an upper portion of the image forming apparatus 100 and below the output tray 17 are toner bottles 9Y, 9C, 9M, and 9Bk containing fresh yellow, cyan, magenta, and black toners, respectively.

The inter mediate transfer belt unit 10 includes a driving roller 72 and a driven roller 73 over which the intermediate transfer belt 11 is looped, in addition to the intermediate transfer belt 11 and the primary transfer rollers 12Y, 12C, 12M, and 12Bk. Since the driven roller 73 also serves as a tension applicator that applies tension to the intermediate transfer belt 11, a biasing member (e.g., a spring) biases the driven roller 73 against the intermediate transfer belt 11. The intermediate transfer belt unit 10, the secondary transfer roller 5, and the intermediate transfer belt cleaner 13 construct a transfer device 71.

The intermediate transfer belt cleaner 13 of the transfer device 71 includes a cleaning brush and a cleaning blade being disposed opposite and contacting the intermediate transfer belt 11. The cleaning brush and the cleaning blade scrape a foreign substance such as residual toner particles off the intermediate transfer belt 11, removing the foreign substance from the intermediate transfer belt 11. The intermediate transfer belt cleaner 13 further includes a waste toner conveyer that conveys the residual toner particles removed from the intermediate transfer belt 11.

Figure 2:
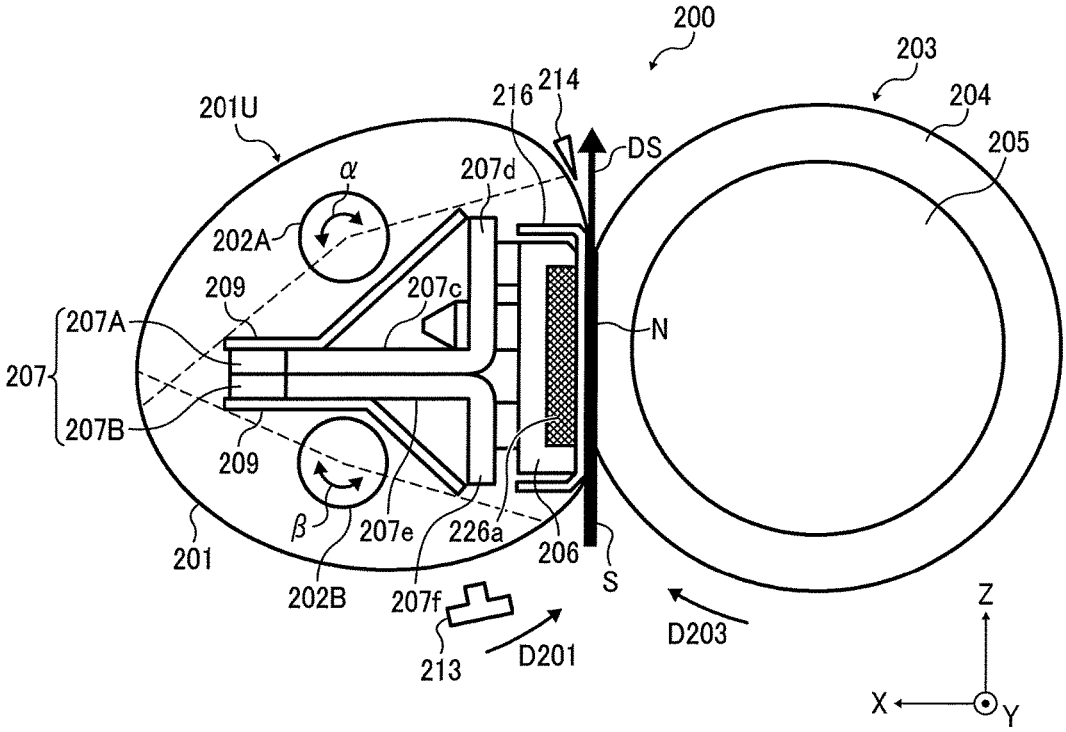
FIG. 2 is a schematic vertical cross-sectional view of a fixing device incorporated in the image forming apparatus depicted in FIG. 1.

Referring to FIG. 2, a description is provided of a construction and an operation of the fixing device 200 incorporated in the image forming apparatus 100 having the construction described above.

FIG. 2 is a schematic vertical cross-sectional view of the fixing device 200. In FIG. 2, Z-direction represents a vertical direction. Y-direction represents a longitudinal direction or an axial direction of the fixing device 200 or the components thereof, which is perpendicular to Z-direction. X-direction represents a width direction of the fixing device 200 or the components thereof, which is perpendicular to Z-direction and Y-direction.

As illustrated in FIG. 2, the fixing device 200 (e.g., a fuser or a fusing unit) includes a thin, flexible, endless fixing belt 201, serving as an endless belt, a fixing rotator, or a fixing member, formed into a loop and rotatable in a rotation direction D201 and a pressure roller 203 serving as a pressure rotator or an opposed rotator disposed outside the loop formed by the fixing belt 201 and disposed opposite an outer circumferential surface of the fixing belt 201. The pressure roller 203 is rotatable in a rotation direction D203. The fixing belt 201 is tubular or cylindrical. Inside the loop formed by the fixing belt 201 is a plurality of halogen heaters 202A and 202B serving as fixing heaters or main heaters. The halogen heaters 202A and 202B heat the fixing belt 201 with radiation heat or light that irradiates an inner circumferential surface of the fixing belt 201 directly.

Inside the loop formed by the fixing belt 201 is a nip formation pad 206 that forms a fixing nip N between the fixing belt 201 and the pressure roller 203. The fixing belt 201 and the pressure roller 203 sandwich the sheet S at the fixing nip N. A thermal conduction aid 216 covers a nip-side face of the nip formation pad 206, which is disposed opposite the fixing nip N. The nip formation pad 206 is made of a heat resistant material being resistant against temperatures up to 200 degrees centigrade and having an enhanced mechanical strength. For example, the nip formation pad 206 is made of heat resistant resin such as polyimide (PI), polyether ether ketone (PEEK), and PI or PEEK reinforced with glass fiber. Thus, the nip formation pad 206 is immune from thermal deformation at temperatures in a fixing temperature range desirable to fix a toner image on a sheet S, retaining the shape of the fixing nip N and quality of the toner image formed on the sheet S.

The inner circumferential surface of the fixing belt 201 slides over the nip formation pad 206 indirectly via the thermal conduction aid 216. As the sheet S bearing the toner image transferred from the intermediate transfer belt 11 is conveyed through the fixing nip N, the fixing belt 201 and the pressure roller 203 fix the toner image on the sheet S under heat and pressure.

As illustrated in FIG. 2, the thermal conduction aid 216 is planar. Alternatively, the thermal conduction aid 216 may be contoured into a recess or other shapes in cross-section. If the thermal conduction aid 216 is contoured into the recess, the thermal conduction aid 216 directs the leading edge of the sheet S in a sheet conveyance direction DS toward the pressure roller 203 as the sheet S is ejected from the fixing nip N, facilitating separation of the sheet S from the fixing belt 201 and suppressing jamming of the sheet S between the fixing belt 201 and the pressure roller 203.

Inside the loop formed by the fixing belt 201 are lateral end heaters 226*a* and 226*b* and a stay 207. The lateral end heaters 226*a* and 226*b* are mounted on or coupled with both lateral ends of the nip formation pad 206 in Y-direction, that is, a longitudinal direction of the fixing belt 201. The stay 207 supports the nip formation pad 206 against pressure from the pressure roller 203. Each of the lateral end heaters 226*a* and 226*b* is a contact heater that contacts the fixing belt 201 to conduct heat to the fixing belt 201, for example, a resistive heat generator such as a ceramic heater.

Each of the nip formation pad 206, the thermal conduction aid 216, and the stay 207 has a length extending in a longitudinal direction thereof. The thermal conduction aid 216 prevents heat generated by the lateral end heaters 226*a* and 226*b* from being stored locally and facilitates conduction and diffusion of heat in the longitudinal direction of the thermal conduction aid 216, thus reducing uneven temperature of the fixing belt 201 in an axial direction thereof. Hence, the thermal conduction aid 216 is made of a material that conducts heat quickly, for example, a material having an increased thermal conductivity such as copper, aluminum, and silver. It is preferable that the thermal conduction aid 216 is made of copper in a comprehensive view of manufacturing costs, availability, thermal conductivity, and processing.

The thermal conduction aid 216 includes a belt-side face that is disposed opposite the inner circumferential surface of the fixing belt 201 and serves as a nip formation face contacting the inner circumferential surface of the fixing belt 201 directly. Hence, a lubricant such as fluorine grease and silicone oil is applied between the thermal conduction aid 216 and the inner circumferential surface of the fixing belt 201 to reduce a slide torque of the fixing belt 201.

A temperature sensor 213 is disposed opposite the outer circumferential surface of the fixing belt 201 at a proper position thereon, for example, a position upstream from the fixing nip N in the rotation direction D201 of the fixing belt 201. The temperature sensor 213 serves as a temperature detector that detects the temperature of the fixing belt 201. A separator 214 is disposed downstream from an exit of the fixing nip N in the sheet conveyance direction DS to separate the sheet S from the fixing belt 201. A pressurization assembly presses the pressure roller 203 against the nip formation pad 206 via the fixing belt 201 and releases pressure exerted by the pressure roller 203 to the fixing belt 201.

A detailed description is now given of a construction of the stay 207.

The stay 207 is situated inside the loop formed by the fixing belt 201. The stay 207 serves as a support that supports the nip formation pad 206 to form the fixing nip N. The stay 207 supports the nip formation pad 206 against pressure from the pressure roller 203 to prevent bending of the nip formation pad 206 and produce an even length of the fixing nip N in the sheet conveyance direction DS throughout the entire width of the fixing belt 201 in the axial direction thereof. The stay 207 is mounted on and held by flanges serving as a holder at both lateral ends of the stay 207 in the longitudinal direction thereof, respectively, thus being positioned inside the fixing device 200.

The stay 207 includes a pair of a first portion 207A and a second portion 207B, each of which is substantially L-shaped in cross-section. The first portion 207A includes an arm 207*c* and a vertical portion 207*d*. The arm 207*c* is disposed opposite the fixing nip N via the vertical portion 207*d* and projects from the vertical portion 207*d* in X-direction. The vertical portion 207*d* extends from the arm 207*c* vertically upward in FIG. 2 in Z-direction. Similarly, the second portion 207B includes an arm 207*e* and a vertical portion 207*f*. The aim 207*e* is disposed opposite the fixing nip N via the vertical portion 207*f* and projects from the vertical portion 207*f* in X-direction. The vertical portion 207*f* extends from the arm 207*e* vertically downward in FIG. 2. The aim 207*c* contacts the arm 207*e*, defining the first portion 207A and the second portion 207B into a T-shape in cross-section.

The arm 207*c* of the first portion 207A and the arm 207*e* of the second portion 207B construct a partition that screens the halogen heater 202A from the halogen heater 202B. The first portion 207A and the second portion 207B are secured to the nip formation pad 206. The first portion 207A and the second portion 207B extend in a longitudinal direction of the halogen heaters 202A and 202B, that is, Y-direction. The stay 207 is substantially T-shaped in cross-section as illustrated in FIG. 2 and also illustrated in FIGS. 4 and 5 later.

The first portion 207A and the second portion 207B interposed between the halogen heaters 202A and 202B define a first compartment accommodating the halogen heater 202A and a second compartment accommodating the halogen heater 202B, respectively. The halogen heaters 202A and 202B emit light that irradiates the inner circumferential surface of the fixing belt 201, thus heating the fixing belt 201 directly with radiation heat. The halogen heaters 202A and 202B are not surrounded by the first portion 207A and the second portion 207B, respectively. For example, centers of the halogen heaters 202A and 202B in cross-section are outside spaces defined or enclosed by the first portion 207A and the second portion 207B, respectively. Accordingly, the halogen heaters 202A and 202B attain obtuse irradiation angles a and 13, respectively, of light that irradiates the fixing belt 201, thus improving heating efficiency.

A reflector 209 (e.g., a thin plate) is interposed between the halogen heater 202A and the first portion 207A to reflect light radiated from the halogen heater 202A toward the fixing belt 201 so as to improve heating efficiency of the halogen heater 202A to heat the fixing belt 201. Another reflector 209 is interposed between the halogen heater 202B and the second portion 207B to reflect light radiated from the halogen heater 202B toward the fixing belt 201 so as to improve heating efficiency of the halogen heater 202B to heat the fixing belt 201. The reflectors 209 prevent heat such as infrared lays radiated from the halogen heaters 202A and 202B from heating the first portion 207A and the second portion 207B, respectively, suppressing waste of energy. Alternatively, instead of the reflectors 209, a surface of each of the first portion 207A and the second portion 207B may be treated with insulation or mirror finish to reflect radiant light radiated from the halogen heaters 202A and 202B to the first portion 207A and the second portion 207B toward the fixing belt 201.

The fixing belt 201 and the components disposed inside the loop formed by the fixing belt 201, that is, the halogen heaters 202A and 202B, the nip formation pad 206, the stay 207, the reflectors 209, and the thermal conduction aid 216, may construct a belt unit 201U separably coupled with the pressure roller 203.

A detailed description is now given of a construction of the pressure roller 203.

The pressure roller 203 is constructed of a core bar 205 and an elastic layer 204 coating the core bar 205. A release layer coats the elastic layer 204 made of rubber. The release layer has a predetermined layer thickness in a range of from 5 micrometers to 50 micrometers, for example, and is made of perfluoroalkoxy alkane (PFA) or polytetrafluoroethylene (PTFE) to facilitate separation of the sheet S from the pressure roller 203.

As a driving force generated by a driver (e.g., a motor) situated inside the image forming apparatus 100 depicted in FIG. 1 is transmitted to the pressure roller 203 through a driving force transmitter such as a gear train and a belt, the pressure roller 203 rotates in the rotation direction D203. Alternatively, the driver may also be connected to the fixing belt 201 to drive and rotate the fixing belt 201 A biasing member such as a spring biases the pressure roller 203 against the fixing belt 201. As the elastic layer 204 of the pressure roller 203 is pressed and deformed elastically, the pressure roller 203 produces the fixing nip N having a predetermined length in the sheet conveyance direction DS.

The pressure roller 203 may be a solid roller. Preferably, the pressure roller 203 may be a hollow roller because the hollow roller has a decreased thermal capacity. If the pressure roller 203 is the hollow roller, a heater or a heat source such as a halogen heater may be disposed inside the pressure roller 203.

The elastic layer 204 may be made of solid rubber. Alternatively, if no heater is situated inside the pressure roller 203, the elastic layer 204 may be made of sponge rubber. The sponge rubber is more preferable than the solid rubber because the sponge rubber has an increased insulation that draws less heat from the fixing belt 201.

A detailed description is now given of a construction of the fixing belt 201.

The fixing belt 201 has a layer thickness in a range of from about 30 micrometers to about 50 micrometers and is an endless belt or film made of metal such as nickel and SUS stainless steel or resin such as polyimide. The fixing belt 201 is constructed of a base layer and a release layer. The release layer serving as an outer surface layer is made of PFA, PTFE, or the like to facilitate separation of toner of the toner image on the sheet S from the fixing belt 201, thus preventing the toner of the toner image from adhering to the fixing belt 201. Optionally, an elastic layer may be sandwiched between the base layer and the release layer and made of silicone rubber or the like.

If the fixing belt 201 does not incorporate the elastic layer, the fixing belt 201 has a decreased thermal capacity that improves fixing property of being heated quickly to a desired fixing temperature at which the toner image is fixed on the sheet S. However, as the pressure roller 203 and the fixing belt 201 sandwich and press the unfixed toner image on the sheet S passing through the fixing nip N, slight surface asperities of the fixing belt 201 may be transferred onto the toner image on the sheet S, resulting in variation in gloss of the solid toner image that may appear as an orange peel image on the sheet S. To address this circumstance, the elastic layer made of silicone rubber has a thickness not smaller than 100 micrometers. As the elastic layer deforms, the elastic layer absorbs slight surface asperities of the fixing belt 201, preventing formation of the faulty orange peel image and variation in gloss of the toner image fixed on the sheet S.

As the driver drives and rotates the pressure roller 203 in the rotation direction D203, the fixing belt 201 rotates in the rotation direction D201 in accordance with rotation of the pressure roller 203 by friction therebetween. At the fixing nip N, the fixing belt 201 rotates as the fixing belt 201 is sandwiched between the pressure roller 203 and the thermal conduction aid 216; at a circumferential span of the fixing belt 201 other than the fixing nip N, the fixing belt 201 is guided and supported by the flange at each lateral end of the fixing belt 201 in the axial direction thereof while the fixing belt 201 retains a tubular shape. Thus, the fixing belt 201 rotates while the flanges retain the fixing belt 201 to be circular in cross-section stably.

With the construction described above, the fixing device 200 attaining quick warm-up is manufactured at reduced costs.

Figure 3:
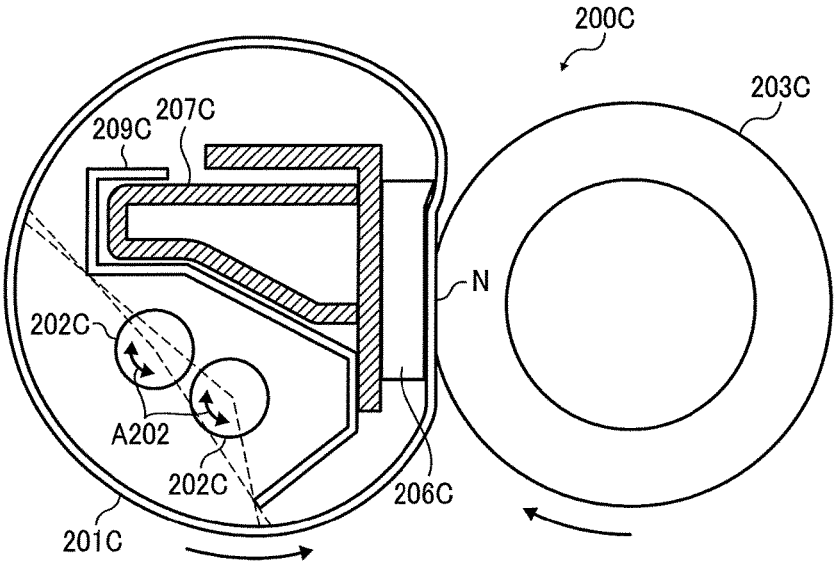
FIG. 3 is a schematic vertical cross-sectional view of a first comparative fixing device incorporating two halogen heaters.

Referring to FIG. 3, a description is provided of one example of a construction of a first comparative fixing device 200C.

FIG. 3 is a schematic vertical cross-sectional view of the first comparative fixing device 200C incorporating two halogen heaters 202C. The first comparative fixing device 200C includes a fixing belt 201C, the halogen heaters 202C, a pressure roller 203C, a nip formation pad 206C, and a stay 207C. The two halogen heaters 202C are substantially surrounded by a reflector 209C that may decrease a radiation amount of light that irradiates the fixing belt 201C and narrow an irradiation angle of light that irradiates the fixing belt 201C as illustrated by irradiation angles A202, degrading heating efficiency of the halogen heaters 202C. The irradiation angle A202 defines an angle formed by light being radiated from the halogen heater 202C and irradiating the fixing belt 201C directly. For example, one of the halogen heaters 202C is a center heater that heats a center span of the fixing belt 201C in an axial direction thereof. Another one of the halogen heaters 202C is a lateral end heater that heats both lateral end spans of the fixing belt 201C in the axial direction thereof.

If the first comparative fixing device 200C heats and fixes a toner image on an A3 extension size sheet, the lateral end heater is requested to have a heat generation span extending to a lateral edge of theA3 extension size sheet in the axial direction of the fixing belt 201C. Accordingly, when a standard size sheet such as anA3 size sheet is conveyed over the fixing belt 201C, each lateral end of the fixing belt 201C in the axial direction thereof may suffer from overheating. To address this circumstance, the first comparative fixing device 200C may incorporate a rotatable shield that shields each lateral end of the fixing belt 201C in the axial direction thereof from the halogen heater 202C, increasing manufacturing costs.

Figure 4:
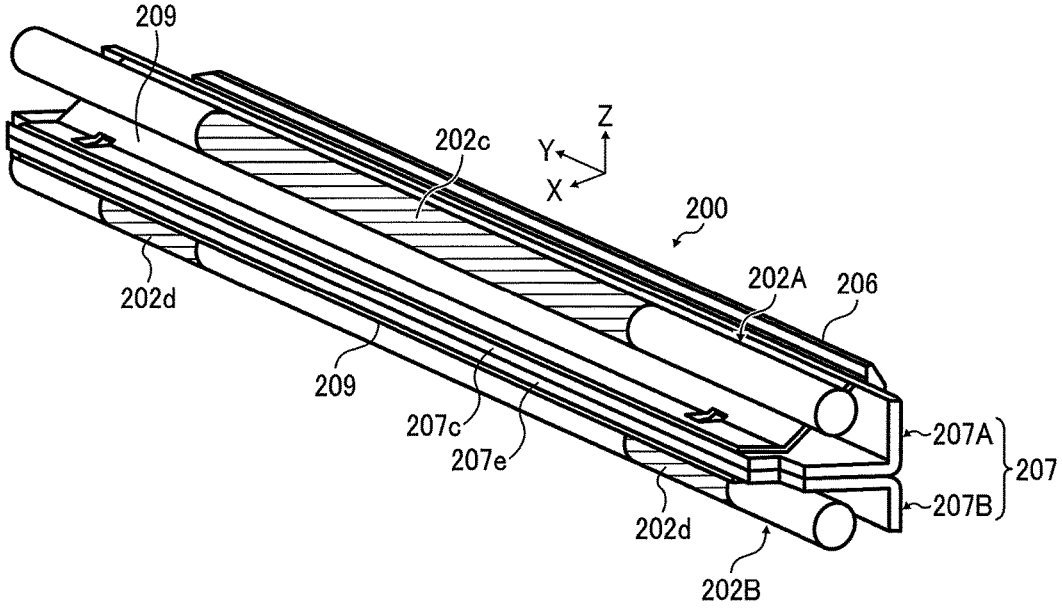
FIG. 4 is a partial perspective view of the fixing device depicted in FIG. 2.

To address this circumstance of the first comparative fixing device 200C, the fixing device 200 according to this embodiment has a construction described below. FIG. 4 is a partial perspective view of the fixing device 200. As illustrated in FIGS. 2 and 4, the first portion 207A and the second portion 207B interposed between the halogen heaters 202A and 202B define the first compartment accommodating the halogen heater 202A and the second compartment accommodating the halogen heater 202B, respectively. Accordingly, unlike the halogen heaters 202C of the first comparative fixing device 200C depicted in FIG. 3, while the halogen heaters 202A and 202B are powered on, the halogen heaters 202A and 202B do not heat each other, preventing degradation in heating efficiency of the halogen heaters 202A and 202B. As illustrated in FIG. 4, the halogen heater 202A includes a heat generator 202*c* that is hatched. The halogen heater 202B includes heat generators 202*d* that are hatched.

The stay 207 supports the nip formation pad 206 against pressure from the pressure roller 203 to prevent bending of the nip formation pad 206 and produce the even length of the fixing nip N in the sheet conveyance direction DS throughout the entire width of the fixing belt 201 in the axial direction thereof. As illustrated in FIG. 2, according to this embodiment, the pressure roller 203 is pressed against the fixing belt 201 to form the fixing nip N. Alternatively, the nip formation pad 206 may be pressed against the pressure roller 203 to form the fixing nip N. The stay 207 has a mechanical strength great enough to support the nip formation pad 206 to prevent bending of the nip formation pad 206. The stay 207 is made of metal such as stainless steel and iron, metal oxide such as ceramics, or the like.

Figure 5:
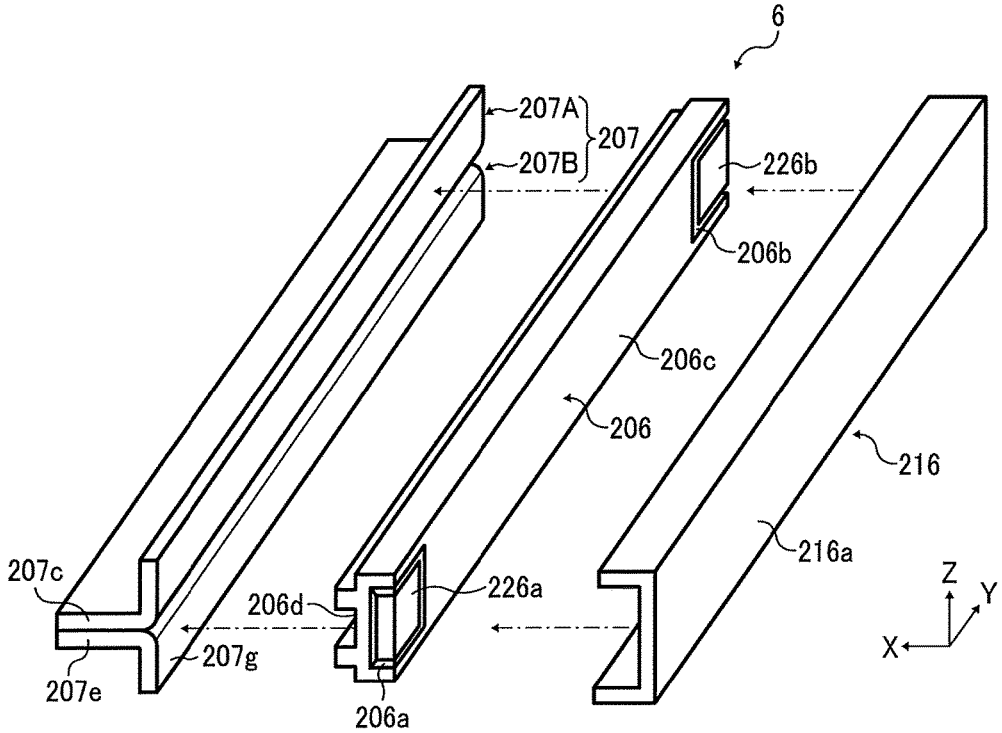
FIG. 5 is an exploded perspective view of a nip formation unit incorporated in the fixing device depicted in FIG. 2.

Referring to FIG. 5, a description is provided of a construction of the nip formation unit 6 serving as a nip former of the fixing device 200 according to this embodiment.

FIG. 5 is an exploded perspective view of the nip formation unit 6 incorporated in the fixing device 200, illustrating the construction of the nip formation unit 6. As illustrated in FIG. 5, the nip formation pad 206 includes a belt-side face 206*c* disposed opposite the inner circumferential surface of the fixing belt 201 depicted in FIG. 2 and a stay-side face 206*d* being opposite the belt-side face 206*c* and disposed opposite the stay 207. The stay 207 includes a belt-side face 207*g* disposed opposite the inner circumferential surface of the fixing belt 201. In other words, the belt-side face 207*g* is a face that is perpendicular to the arms 207*c* and 207*e* of the first portion 207A and the second portion 207B, respectively, and disposed opposite the pressure roller 203. The stay-side face 206*d* of the nip formation pad 206 contacts the belt-side face 207*g* of the stay 207. The stay-side face 206*d* is secured to the belt-side face 207*g* through a fastener, thus coupling the nip formation pad 206 with the stay 207. For example, the stay-side face 206*d* and the belt-side face 207*g* mount a boss and a pin that engage each other, thus securing and coupling the nip formation pad 206 to the stay 207.

The thermal conduction aid 216 engages the nip formation pad 206 that is substantially rectangular such that the thermal conduction aid 216 covers the belt-side face 206*c* of the nip formation pad 206 that is disposed opposite the inner circumferential surface of the fixing belt 201. Thus, the thermal conduction aid 216 is coupled with the nip formation pad 206. For example, the thermal conduction aid 216 is coupled with the nip formation pad 206 with a claw, an adhesive, or the like.

The nip formation pad 206 includes recesses 206*a* and 206*b*, serving as steps, disposed at both lateral ends of the nip formation pad 206, respectively, in the longitudinal direction of the nip formation pad 206. The recesses 206*a* and 206*b* accommodate the lateral end heaters 226*a* and 226*b*, respectively. The lateral end heaters 226*a* and 226*b* are secured to the recesses 206*a* and 206*b*, respectively, with an adhesive or the like.

The thermal conduction aid 216 includes a belt-side face 216*a*, that is, a nip formation face, which is disposed opposite the pressure roller 203 depicted in FIG. 2. However, since the belt-side face 206*c* of the nip formation pad 206 has a mechanical strength greater than a mechanical strength of the belt-side face 216*a* of the thermal conduction aid 216, the belt-side face 206*c* disposed opposite the pressure roller 203 serves as a nip formation face that forms the fixing nip N practically.

Figure 6:
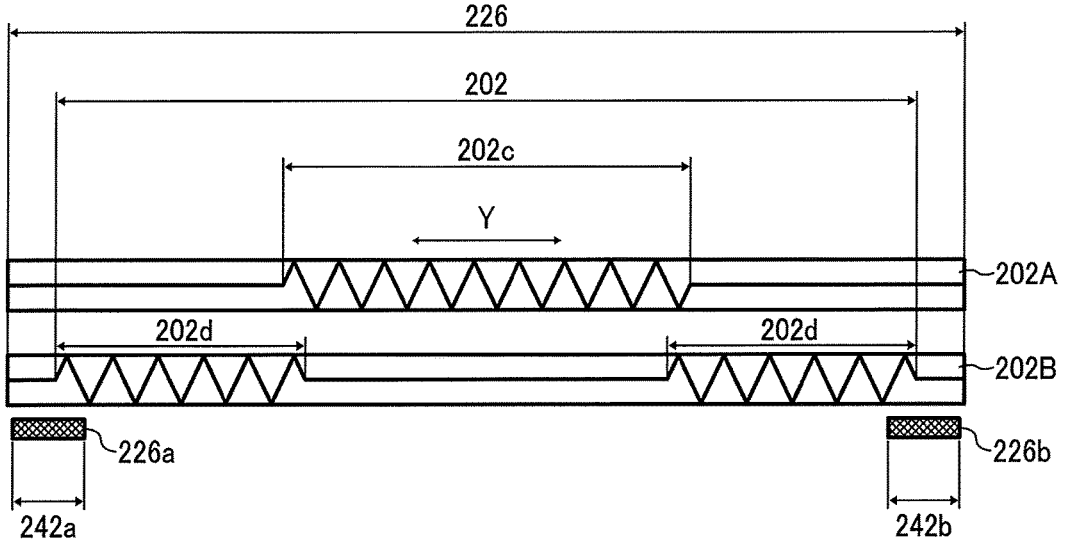
FIG. 6 is a diagram of halogen heaters and lateral end heaters incorporated in the fixing device depicted in FIG. 2, illustrating arrangement and light distribution thereof.

Referring to FIG. 6, a description is provided of arrangement of the lateral end heaters 226*a* and 226*b* to correspond to sheets S of special sizes such as anA3 extension size and a 13-inch size.

FIG. 6 is a diagram of the halogen heaters 202A and 202B and the lateral end heaters 226*a* and 226*b*, illustrating arrangement and light distribution thereof.

As illustrated in FIG. 6, the halogen heater 202A includes a heat generator 202*c* serving as a center heat generator having a dense light distribution disposed at a center span of the halogen heater 202A, which is disposed opposite a center span of the fixing belt 201 in the axial direction thereof where a small sheet S such as anA4 size sheet in portrait orientation is conveyed over the fixing belt 201.

Conversely, the halogen heater 202B includes a heat generator 202*d* serving as a lateral end heat generator having a dense light distribution disposed at each lateral end span of the halogen heater 202B, which is disposed opposite each lateral end span of the fixing belt 201 in the axial direction thereof where a large sheet S such as anA3 size sheet in portrait orientation is conveyed over the fixing belt 201. The heat generator 202*d* of the halogen heater 202B heats each lateral end span of the fixing belt 201 that is disposed opposite each lateral end of a maximum standard size sheet (e.g., theA3 size sheet in portrait orientation) in the axial direction of the fixing belt 201 and is not heated by the halogen heater 202A. A heat generator 202 defined by the heat generators 202*c* and 202*d* corresponds to a width of the maximum standard size sheet and does not encompass a width of an extension size sheet that is greater than the width of the maximum standard size sheet.

When the small sheet S is conveyed over the fixing belt 201, the halogen heater 202A is powered on and the halogen heater 202B is not powered on, thus preventing a non-conveyance span, that is, each lateral end span, of the fixing belt 201 where the small sheet S is not conveyed from being heated unnecessarily or preventing overheating of each lateral end span of the fixing belt 201 in the axial direction thereof after a plurality of small sheets S is conveyed over the center span of the fixing belt 201 in the axial direction thereof continuously.

The halogen heaters 202A and 202B and the lateral end heaters 226*a* and 226*b* are energized during an initial time of a print job of conveying sheets S continuously for fixing immediately after warming up the fixing device 200, for example, the initial time when the fixing belt 201 and the pressure roller 203 have not been heated sufficiently. Conversely, when the fixing belt 201 and the pressure roller 203 have been heated sufficiently and temperature decrease at each lateral end of the fixing belt 201 in the axial direction thereof that results from temperature decrease of each lateral end span of the halogen heater 202B caused by the property peculiar to halogen heaters has been reduced, the halogen heaters 202A and 202B are energized or the halogen heater 202A is energized. Hence, the lateral end heaters 226*a* and 226*b* are not energized. Under such heating control, the fixing device 200 reduces overheating or temperature increase in the non-conveyance span on the fixing belt 201 where the sheet S is not conveyed at each lateral end of the fixing belt 201 in the axial direction thereof. Additionally, the fixing belt 201 is not heated unnecessarily, improving heating efficiency and saving energy.

According to this embodiment, the fixing device 200 includes the two halogen heaters 202A and 202B serving as fixing heaters, respectively. Alternatively, the fixing device 200 may include three or more halogen heaters to correspond to various sizes of small sheets S.

A part of a heating span of the lateral end heaters 226*a* and 226*b* in the axial direction of the fixing belt 201 overlaps an outboard part of a heating span of the halogen heater 202B in the axial direction of the fixing belt 201. The lateral end heaters 226*a* and 226*b* are disposed opposite both lateral ends of the halogen heater 202B in the longitudinal direction thereof, respectively. The lateral end heaters 226*a* and 226*b* include heat generators 242*a* and 242*b* that heat both lateral ends of the extension size sheet (e.g., theA3 extension size sheet and the 13-inch sheet) greater than the maximum standard size sheet in the longitudinal direction of the halogen heater 202B, respectively. Thus, a heat generator 226, defined by the heat generators 202*c*, 202, 242*a*, and 242*b*, corresponds to the width of the extension size sheet (e.g., theA3 extension size sheet and the 13-inch sheet).

A part of each of the heat generators 242*a* and 242*b* of the lateral end heaters 226*a* and 226*b*, respectively, overlaps the heat generator 202*d* of the halogen heater 202B in the longitudinal direction of the halogen heater 202B. Accordingly, the fixing belt 201 of the fixing device 200 heats both lateral ends of the extension size sheet (e.g., theA3 extension size sheet and the 13-inch sheet) greater than the maximum standard size sheet in the longitudinal direction of the halogen heater 202B. In other words, the lateral end heaters 226*a* and 226*b* supplement decrease in heat output of the outboard part of the halogen heater 202B in the longitudinal direction thereof that suffers from a decreased heat output.

Figure 7:
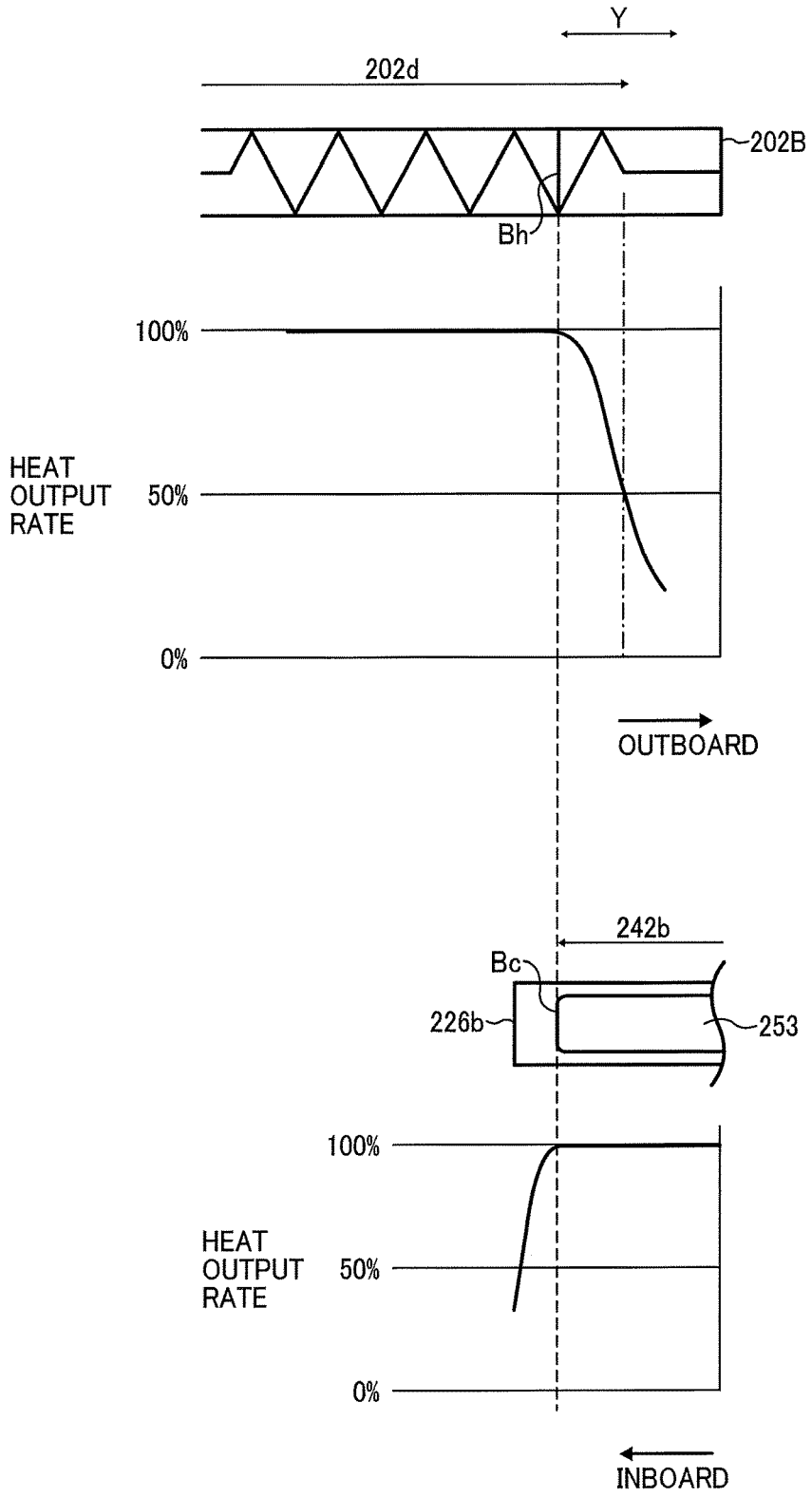
FIG. 7 is a diagram of the halogen heater and the lateral end heater depicted in FIG. 6, illustrating a positional relation between a heat generator of the halogen heater and a heat generator of the lateral end heater and output by the heat generators.

Referring to FIG. 7, a description is provided of an amount of heat (e.g., a heat distribution output or a heating output) output by the halogen heater 202B and the lateral end heater 226*b* to heat the fixing belt 201.

FIG. 7 is a diagram of the halogen heater 202B and the lateral end heater 226*b*, illustrating a positional relation between the heat generator 202*d* of the halogen heater 202B and the heat generator 242*b* of the lateral end heater 226*b* and output by the heat generators 202*d* and 242*b*. An upper part of FIG. 7 illustrates a right lateral end of the heat generator 202*d* of the halogen heater 202B. A lower part of FIG. 7 illustrates a left lateral end of the heat generator 242*b* of the lateral end heater 226*b*.

Generally, a heat generator, in which a filament is coiled helically, of a halogen heater suffers from decrease in heat output at a lateral end of the heat generator in a longitudinal direction of the halogen heater. The decrease in heat output varies depending on a density of the filament coiled helically. The smaller the density of the filament coiled helically, the more the halogen heater is susceptible to the decrease in heat output. As illustrated in the upper part in FIG. 7, the halogen heater 202B does not attain a target heat output rate of 100 percent to an outboard edge of the heat generator 202*d* in the longitudinal direction, that is, Y-direction, of the halogen heater 202B. For example, a lateral end of the heat generator 202*d* of the halogen heater 202B in the longitudinal direction of the halogen heater 202B, which suffers from the decrease in heat output, is defined as a heat generation span from a position at which the heat generator 202*d* attains a predetermined heat output rate of 100 percent to a position at which the heat generator 202*d* suffers from a decreased heat output rate of 50 percent.

As illustrated in the lower part in FIG. 7, the lateral end heater 226*b* also suffers from a decreased heat output rate at an inboard portion disposed inboard from the heat generator 242*b* in a longitudinal direction, that is, Y-direction, of the lateral end heater 226*b*. The inboard portion of the lateral end heater 226*b* is inboard from a resistor 253 that defines a heat generation span. The inboard portion of the lateral end heater 226*b* fails to attain the predetermined heat output rate of 100 percent and suffers from a decreased heat output rate. That is, the lateral end heater 226*b* does not attain a target heat output rate of 100 percent at the inboard portion disposed inboard from the heat generator 242*b* in the longitudinal direction of the lateral end heater 226*b*. Hence, a lateral end of a wiring portion of the lateral end heater 226*b* in the longitudinal direction thereof suffers from a decreased heat output rate.

Accordingly, as the lateral end heater 226*b* and the lateral end of the halogen heater 202B in the longitudinal direction thereof suffer from the decrease in heat output, a toner image formed on the lateral end of the extension size sheet greater than the maximum standard size sheet may not be fixed on the extension size sheet properly.

To address this circumstance, a border Bh at which heat output from the heat generator 202*d* of the halogen heater 202B starts decreasing corresponds to a border Bc at which heat output from the heat generator 242*b* of the lateral end heater 226*b* starts decreasing. The border Bh at which the halogen heater 202B attains the target heat output rate of 100 percent is disposed opposite the border Bc at which the lateral end heater 226*b* attains the target heat output rate of 100 percent.

Since the halogen heater 202B is spaced apart from the lateral end heater 226*b*, the border Bh coincides with the border Bc in the longitudinal direction of the halogen heater 202B on a projection. Similarly, the border Bh at which heat output from another heat generator 202*d* of the halogen heater 202B starts decreasing corresponds to the border Bc at which heat output from the heat generator 242*a* of the lateral end heater 226*a* depicted in FIG. 6 starts decreasing.

Accordingly, the heat generator 202 depicted in FIG. 6 is immune from decrease in heat output in an overlap span where the heat generator 202*d* of the halogen heater 202B overlaps the lateral end heater 226*a* and an overlap span where the heat generator 202*d* of the halogen heater 202B overlaps the lateral end heater 226*b* in the longitudinal direction of the halogen heater 202B, thus retaining the target, predetermined heat output rate of 100 percent. Consequently, even when the extension size sheet greater than the maximum standard size sheet is conveyed over the fixing belt 201, the toner image formed on each lateral end of the extension size sheet in a width direction thereof is fixed on the extension size sheet properly.

As illustrated in FIG. 7, according to this embodiment, the border Bh of the halogen heater 202B coincides with the border Bc of the lateral end heater 226*b*. However, as described above with reference to FIG. 5, the nip formation unit 6 incorporates the thermal conduction aid 216 having an enhanced thermal conductivity that offsets a certain amount of decrease in heat output from the lateral end heaters 226*a* and 226*b* and the halogen heater 202B, thus equalizing the temperature of the fixing belt 201. Hence, the position of the border Bc at which heat output from each of the lateral end heaters 226*a* and 226*b* starts decreasing may be determined within a predetermined allowable range.

A description is provided of a configuration of the thermal conduction aid 216.

As described above, the thermal conduction aid 216 is made of a material having a high thermal conductivity such as copper and aluminum. The thermal conduction aid 216 prevents heat generated by the halogen heaters 202A and 202B and the lateral end heaters 226*a* and 226*b* from being stored locally and facilitates conduction of heat in the longitudinal direction, that is, Y-direction, of the thermal conduction aid 216, thus reducing uneven temperature of the fixing belt 201 in the axial direction thereof. Since the inner circumferential surface of the fixing belt 201 slides over the thermal conduction aid 216, if the thermal conduction aid 216 is made of metal, the inner circumferential surface of the fixing belt 201 may slide over the thermal conduction aid 216 frictionally, increasing a coefficient of friction between the fixing belt 201 and the thermal conduction aid 216. As the coefficient of friction increases, a unit torque of the nip formation unit 6 may increase, shortening the life of the fixing device 200.

To address this circumstance, as illustrated in FIG. 5, the belt-side face 216*a* of the thermal conduction aid 216, which is disposed opposite the fixing belt 201, is smooth. In order to facilitate sliding of the fixing belt 201 over the thermal conduction aid 216 further, the belt-side face 216*a* is treated with processing to reduce the coefficient of friction. For example, the belt-side face 216*a* is coated with a fluorine material such as PFA and PTFE or treated with other coating to reduce friction between the thermal conduction aid 216 and the inner circumferential surface of the fixing belt 201. Thus, the belt-side face 216*a* retains proper sliding of the inner circumferential surface of the fixing belt 201 over the thermal conduction aid 216.

As described above, since the inner circumferential surface of the fixing belt 201 slides over the thermal conduction aid 216, the lubricant such as fluorine grease and silicone oil is applied between the thermal conduction aid 216 and the inner circumferential surface of the fixing belt 201 to reduce friction therebetween further and decrease a sliding torque.

Figure 8:
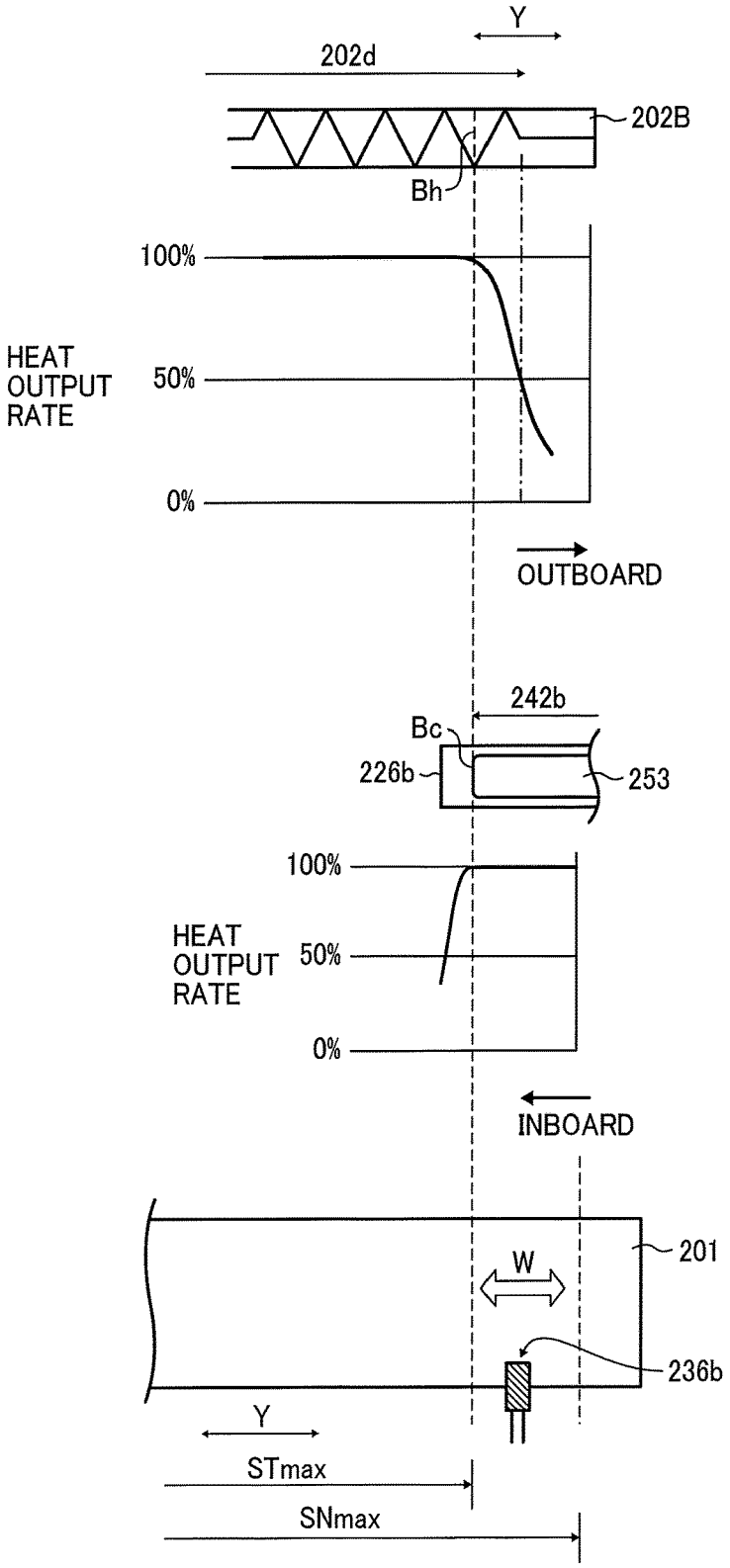
FIG. 8 is a diagram of the halogen heater and the lateral end heater depicted in FIG. 6 and a fixing belt incorporated in the fixing device depicted in FIG. 2, illustrating a temperature sensor disposed opposite the fixing belt.

Referring to FIG. 8, a description is provided of a configuration of another temperature detector, separately provided from the temperature sensor 213 depicted in FIG. 2, which is used to control the temperature of the lateral end heaters 226*a* and 226*b*.

FIG. 8 is a diagram of the halogen heater 202B, the lateral end heater 226*b*, and the fixing belt 201, illustrating a contact thermistor 236*b* serving as a temperature sensor disposed opposite the fixing belt 201. A contact sensor (e.g., a thermistor) is employed to detect the temperature of the fixing belt 201 precisely at reduced costs. However, the contact sensor may produce slight scratches at a contact position on the fixing belt 201 where the contact sensor contacts the fixing belt 201. The slight scratches may damage a toner image formed on a sheet S while the sheet S is conveyed over the fixing belt 201, generating slight variation in gloss of the toner image on the sheet S or the like. To address this circumstance, in the image forming apparatus 100 that forms a color toner image on a sheet S, the contact sensor is not situated within a conveyance span in the axial direction of the fixing belt 201 where the maximum standard size sheet is conveyed over the fixing belt 201.

As described above, according to this embodiment, the lateral end heaters 226*a* and 226*b* heat an extension span of the fixing belt 201 disposed outboard from the heat generator 202*d* of the halogen heater 202B in Y-direction. The heat generator 202*d* heats each lateral end span of the fixing belt 201 disposed opposite each lateral end of the maximum standard size sheet in Y-direction.

The extension size sheet includes an extension portion used as an edge or a margin abutting on a toner image formed in proximity to a lateral edge of the maximum standard size sheet, a portion where a linear image called a trim mark used for alignment in printing positions is formed, or a portion where a solid patch having a small area for color adjustment is formed. Hence, since the extension portion is trimmed finally, even if the contact sensor produces scratches on the fixing belt 201 and the scratches damage a toner image formed on the extension portion of the extension size sheet with slight variation in gloss of the toner image or the like, the damaged toner image barely remains as a final toner image and therefore does not appear on the extension size sheet as a faulty toner image.

Accordingly, as illustrated in a lower part of FIG. 8, the fixing device 200 according to this embodiment includes the contact thermistor 236*b* serving as a temperature detector that detects the temperature of one lateral end of the fixing belt 201 in the axial direction thereof, which is heated by the lateral end heater 226*b*. The fixing device 200 further includes another contact thermistor serving as a temperature detector that detects the temperature of another lateral end of the fixing belt 201 in the axial direction thereof, which is heated by the lateral end heater 226*a*. The contact thermistor 236*b* is disposed opposite the outer circumferential surface of the fixing belt 201.

The contact thermistor 236*b* is disposed outboard from a maximum standard size sheet conveyance span STmax in Y-direction of the fixing belt 201. The maximum standard size sheet conveyance span STmax defines a span where the maximum standard size sheet is conveyed over the fixing belt 201. The contact thermistor 236*b* is disposed within an extension size sheet conveyance span SNmax in Y-direction of the fixing belt 201. The extension size sheet conveyance span SNmax is greater than the maximum standard size sheet conveyance span STmax and defines a span where the extension size sheet is conveyed over the fixing belt 201. That is, the contact thermistor 236*b* is disposed in a span W defined from a lateral edge of the maximum standard size sheet conveyance span STmax to a lateral edge of the extension size sheet conveyance span SNmax in Y-direction of the fixing belt 201. Accordingly, the fixing device 200 employs the contact thermistor 236*b* manufactured at reduced costs to detect the temperature of the fixing belt 201 precisely while preventing a faulty toner image that suffers from slight variation in gloss or the like from appearing on the extension size sheet.

The lower part of FIG. 8 illustrates the contact thermistor 236*b* disposed opposite a heated span of the fixing belt 201 that is heated by the lateral end heater 226*b*. Another contact thermistor having a configuration similar to that of the contact thermistor 236*b*, although it is not illustrated in FIG. 8, is disposed opposite the heated span of the fixing belt 201 that is heated by the lateral end heater 226*a*.

A description is provided of a construction of a second comparative fixing device.

The second comparative fixing device includes a plurality of halogen heaters having different heating spans to achieve different heat or light distributions so as to fix toner images on recording media of various sizes, respectively. For example, the second comparative fixing device includes a heater A having a heat distribution corresponding to a width of an A4 size sheet in portrait orientation (e.g., 210 mm) and a heater B having a heat distribution corresponding to a difference between the width of theA4 size sheet in portrait orientation and a width of an A3 size sheet in portrait orientation (e.g., 297 mm).

The second comparative fixing device is requested to form a toner image on an extension size sheet having a width greater than the width of theA3 size sheet in portrait orientation. To address this request, the second comparative fixing device may incorporate a halogen heater that attains a heat distribution corresponding to the width of the extension size sheet. However, after a plurality of sheets, each of which has a width not greater than the width of theA3 size sheet in portrait orientation, is conveyed over a fixing belt continuously, a non-conveyance span of the fixing belt where the sheets have not been conveyed may overheat, resulting in adjustment of productivity of the second comparative fixing device.

A description is provided of a construction of a third comparative fixing device configured to heat the extension size sheet.

The third comparative fixing device includes a fixing heater that heats a center span of a fixing belt in an axial direction thereof and lateral end heaters that are mounted on a nip formation pad and heat both lateral end spans of the fixing belt in the axial direction thereof, respectively. The third comparative fixing device further includes a thermal conduction aid that contacts the fixing belt and the lateral end heaters.

The lateral end heaters are mounted locally on both lateral ends of the nip formation pad in a longitudinal direction thereof, respectively. The lateral end heaters heat both lateral end spans of the fixing belt in the axial direction thereof to heat the extension size sheet. Heat generated by the lateral end heaters is conducted to the fixing belt through the thermal conduction aid contacting an inner circumferential surface of the fixing belt. The lateral end heaters locally mounted on the nip formation pad heat the extension size sheet without an extra halogen heater directed to the extension size sheet.

The lateral end heater is a ceramic heater that includes a base made of ceramics or the like and a resistive heat generator mounted on the base. An electrode of a power supply portion is combined with the resistive heat generator by brazing or soldering to supply power to the resistive heat generator. However, since brazing and soldering do not attain a sufficient heat resistance, the power supply portion may suffer from degradation in heat resistance. In order to increase heat resistance of the power supply portion, the power supply portion may be combined with the resistive heat generator with high melting point solder or silver.

With the power supply portion incorporating the electrode that is combined with the resistive heat generator to supply power to the resistive heat generator, the electrode of the power supply portion of the lateral end heater may be overheated and damaged. Additionally, each lateral end of the thermal conduction aid in a longitudinal direction thereof, as it contacts the inner circumferential surface of the fixing belt, may damage the inner circumferential surface of the fixing belt.

A description is provided of a referential example and three embodiments, that is, first to third embodiments, of a construction of the lateral end heaters 226*a* and 226*b* and arrangement of the lateral end heaters 226*a* and 226*b* and the thermal conduction aid 216.

Figure 9A:
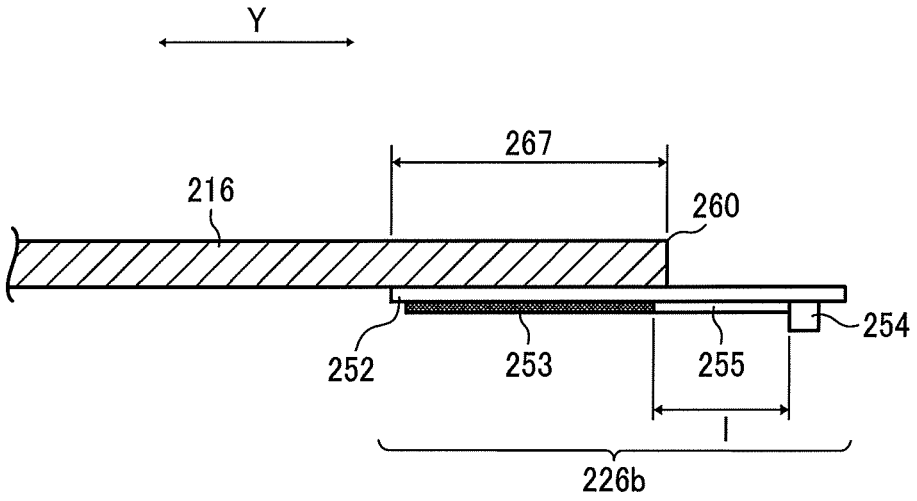
FIG. 9A is a cross-sectional view of the lateral end heater and a the, vial conduction aid incorporated in the fixing device depicted in FIG. 2 according to a referential example.
Figure 9B:
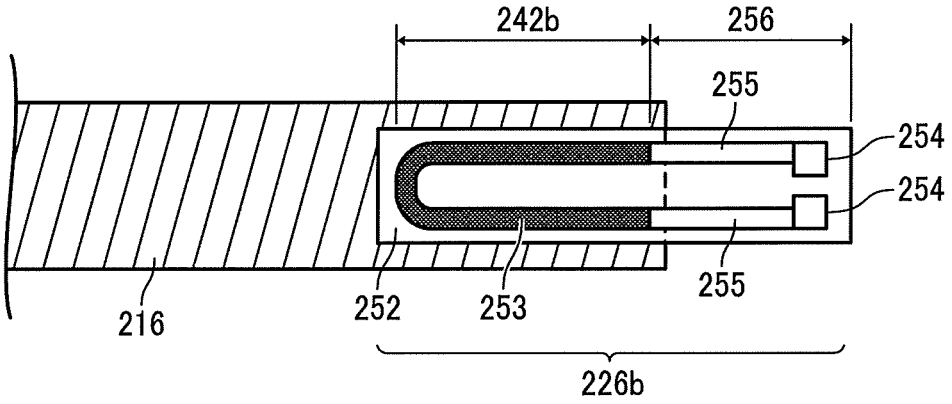
FIG. 9B is a front view of the lateral end heater and the thermal conduction aid depicted in FIG. 9A.

Referring to FIGS. 9A and 9B, a description is provided of the referential example of the construction of the lateral end heaters 226*a* and 226*b* and arrangement of the lateral end heaters 226*a* and 226*b* and the thermal conduction aid 216.

FIGS. 9A and 9B illustrate the construction of the lateral end heater 226*b* and arrangement of the lateral end heater 226*b* and the thermal conduction aid 216 according to the referential example. FIG. 9A is a cross-sectional view of the lateral end heater 226*b* and the thermal conduction aid 216. FIG. 9B is a front view of the lateral end heater 226*b* and the thermal conduction aid 216, seen from the stay 207 depicted in FIG. 2. Although FIGS. 9A and 9B illustrate the lateral end heater 226*b*, the lateral end heater 226*a* is symmetrical with the lateral end heater 226*b* and has a construction similar to a construction of the lateral end heater 226*b* described below.

As illustrated in FIGS. 9A and 9B, the lateral end heater 226*b* includes a base 252, a resistor 253, a plurality of electrodes 254, and a plurality of conductors 255. The resistor 253 is mounted on the base 252. The plurality of electrodes 254 is mounted on the base 252 and coupled to an external power supply. The electrodes 254 supply power to the resistor 253. The conductors 255 are mounted on the base 252. Each of the conductors 255 is a joint that couples the resistor 253 with the electrode 254. The lateral end heater 226*b* is a ceramic heater in which the resistor 253 is mounted on the base 252. The plurality of electrodes 254 constructs a power supply portion 256 that supplies power to the resistor 253.

As illustrated in FIG. 9A, the base 252 contacts and extends beyond a lateral end 267 of the thermal conduction aid 216 in the longitudinal direction thereof, that is, Y-direction. The base 252 is made of ceramics, for example. The resistor 253 is a resistive heat generator or a heat generator that generates heat as the resistive heat generator is supplied with power. The resistor 253 is substantially U-shaped, for example, as illustrated in FIG. 9B. The conductor 255 does not generate heat.

Since the power supply portion 256 of the lateral end heater 226*b* has a low heat resistance, when the resistor 253 generates heat, a joint portion or the like of the electrode 254, that is treated with brazing or soldering, may be damaged by heat generated by the resistor 253. In order to prevent the joint portion of the electrode 254 from being damaged, each of the electrodes 254 coupled to the resistor 253 is spaced apart from the resistor 253 via the conductor 255. The resistor 253 is disposed opposite the lateral end 267 of the thermal conduction aid 216 in the longitudinal direction thereof, that is, Y-direction. Conversely, the electrodes 254 are disposed outboard from the lateral end 267 of the thermal conduction aid 216 in the longitudinal direction thereof. A distance I defined from an outboard edge of the heat generator 242*b* to an inboard edge of the electrode 254 in Y-direction is not smaller than 10 mm when the resistor 253 is supplied with power of 55 W. According to this referential example, the distance 1 is 12 mm like in the first to third embodiments described below. In order to increase heat resistance of the electrodes 254, the electrodes 254 may be attached to the conductors 255 with high melting point solder or silver.

As illustrated in FIG. 9B, the thermal conduction aid 216 is disposed opposite the base 252 of the lateral end heater 226*b* and covers the heat generator 242*b* of the lateral end heater 226*b*. As illustrated in FIG. 9A, the lateral end 267 of the thermal conduction aid 216 defines a contact span where the base 252 of the lateral end heater 226*b* contacts and overlaps the thermal conduction aid 216 in the longitudinal direction thereof.

According to the referential example, with the construction of the lateral end heater 226*b* described above, as the external power supply supplies power to the electrodes 254, the resistor 253 generates heat. The temperature of the heat generator 242*b* defined by the resistor 253 increases to a high temperature. Heat generated by the heat generator 242*b* is conducted to the thermal conduction aid 216. Conversely, heat generated by the heat generator 242*b* is barely conducted to the electrodes 254 spaced apart from the heat generator 242*b*, preventing overheating of the power supply portion 256 including the electrodes 254.

A length of the fixing belt 201 in the axial direction thereof, that is, Y-direction, is greater than a length of the thermal conduction aid 216 in view of a position of the flanges inserted into both lateral ends of the fixing belt 201 in Y-direction to support the fixing belt 201 and a length of the pressure roller 203 in Y-direction. If the thermal conduction aid 216 is excessively longer than a conveyance span of the fixing belt 201 where the sheet S is conveyed, an outboard span of the thermal conduction aid 216, which is outboard from the conveyance span in Y-direction, may suffer from temperature increase, thus increasing power consumption and degrading heating efficiency. To address this circumstance, the length of the thermal conduction aid 216 in the longitudinal direction thereof is not set unnecessarily long relative to a maximum conveyance span of the fixing belt 201 where a maximum size sheet is conveyed by considering dimensional tolerance of parts, mounting backlash, variation in size of the sheet S, variation in position at which the sheet S is conveyed, variation in heating span to heat the fixing belt 201, and the like.

According to the referential example, as described above, since the thermal conduction aid 216 is made of copper, aluminum, or the like, a rigidity of the thermal conduction aid 216 is greater than a rigidity of the fixing belt 201. Accordingly, as the fixing belt 201 rotates, a corner 260 disposed at each lateral edge of the thermal conduction aid 216 in Y-direction may damage the inner circumferential surface of the fixing belt 201, shortening the life of the fixing belt 201. Additionally, a portion of the lateral end heater 226*b* that is disposed outboard from the lateral end 267 of the thermal conduction aid 216 in Y-direction, which is called the power supply portion 256 or an electrode portion, may be disposed in proximity to or in contact with the inner circumferential surface of the fixing belt 201.

Figure 10A:
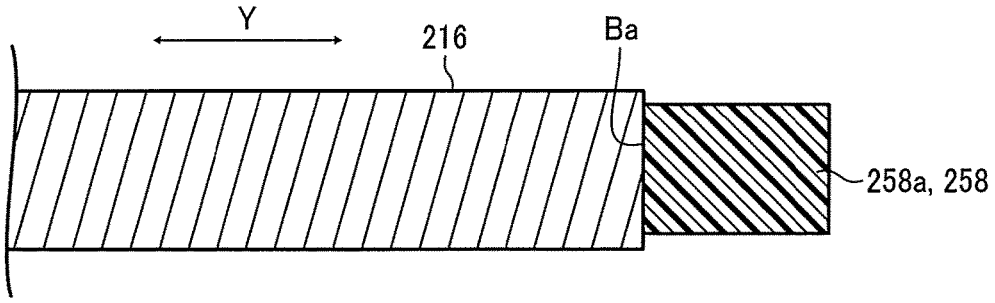
FIG. 10A is a rear view of the thermal conduction aid incorporated in the fixing device depicted in FIG. 2 according to a first embodiment.
Figure 10B:
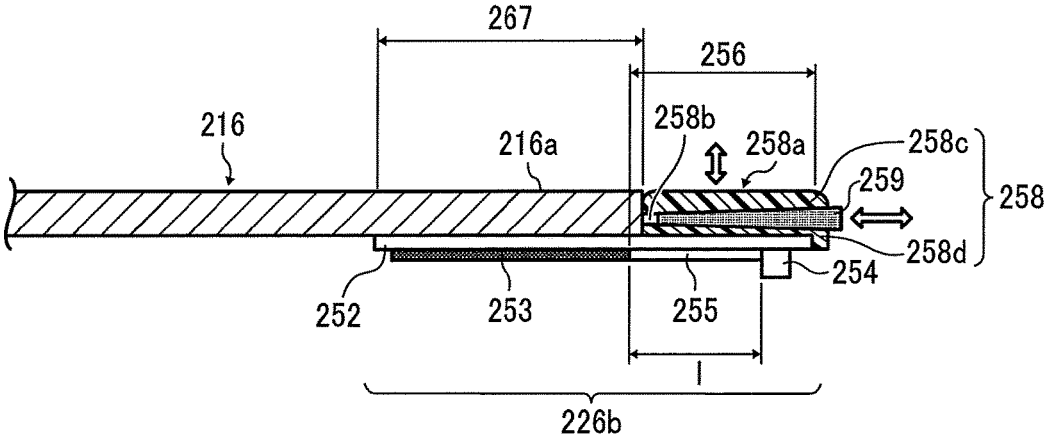
FIG. 10B is a cross-sectional view of the lateral end heater and the thermal conduction aid depicted in FIG. 10A.
Figure 10C:
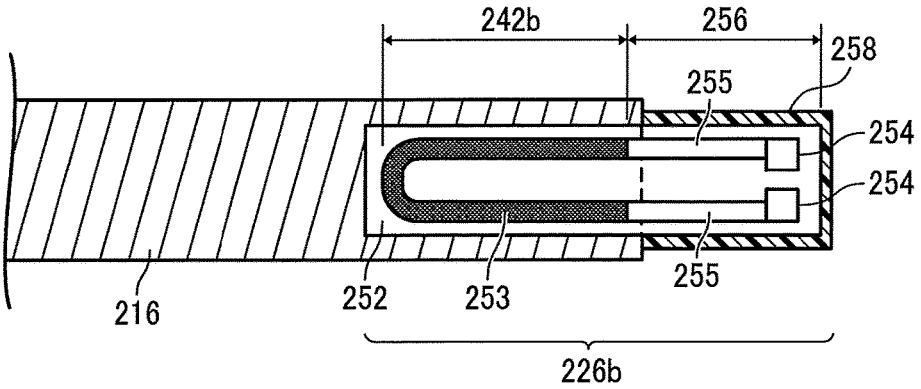
FIG. 10C is a front view of the lateral end heater and the thermal conduction aid depicted in FIG. 10B.

Referring to FIGS. 10A, 10B, and 10C, a description is provided of the construction of the lateral end heaters 226*a* and 226*b* and arrangement of the lateral end heaters 226*a* and 226*b* and the thermal conduction aid 216 according to the first embodiment.

FIGS. 10A, 10B, and 10C illustrate the construction of the lateral end heater 226*b* and arrangement of the lateral end heater 226*b* and the thermal conduction aid 216 according to the first embodiment. FIG. 10A is a rear view of the thermal conduction aid 216 seen from the fixing belt 201 or the fixing nip N depicted in FIG. 2 FIG. 10B is a cross-sectional view of the lateral end heater 226*b* and the thermal conduction aid 216. FIG. 10C is a front view of the lateral end heater 226*b* and the thermal conduction aid 216, seen from the stay 207 depicted in FIG. 2.

In order to address the above-described circumstance of the referential example depicted in FIGS. 9A and 9B, the first embodiment illustrated in FIGS. 10A, 10B, and 10C is different from the referential example in that the first embodiment incorporates a cover 258 and a cover height adjuster 259 as described below. The cover 258 covers the power supply portion 256 incorporating the electrodes 254. The cover height adjuster 259 adjusts the height of a cover face 258*a* of the cover 258. The cover face 258*a* is disposed opposite the inner circumferential surface of the fixing belt 201.

The cover 258 covers the power supply portion 256 to prevent the power supply portion 256 from coming into contact with the inner circumferential surface of the fixing belt 201. For example, the cover 258 covers the power supply portion 256 disposed opposite the inner circumferential surface of the fixing belt 201 and disposed outboard from the lateral end 267 of the thermal conduction aid 216 in the longitudinal direction thereof.

The cover 258 is made of heat resistant resin, such as liquid crystal polymer (LCP), polyphenylenesultide (PPS), and PFA, which is softer than the material of the thermal conduction aid 216, that is, metal such as copper and aluminum. The cover 258 made of the heat resistant resin such as LCP, PPS, and PFA is heat resistant. The cover face 258*a* of the cover 258, which is disposed opposite the fixing belt 201, is smooth and treated with processing to reduce friction between the cover face 258*a* and the inner circumferential surface of the fixing belt 201. Accordingly, even if the cover 258 comes into contact with the inner circumferential surface of the fixing belt 201, the cover 258 does not hinder rotation of the fixing belt 201.

The cover height adjuster 259 serves as a height adjuster that adjusts the height of the cover face 258*a* of the cover 258 such that the cover face 258*a* defines an identical plane with the belt-side face 216*a* of the thermal conduction aid 216, which is disposed opposite the inner circumferential surface of the fixing belt 201 or the cover face 258*a* projects beyond the belt-side face 216*a* as a bulge or a projection.

As illustrated in FIG. 10B, the cover height adjuster 259 is a wedge. The cover 258 includes an upper portion 258*c* serving as a first portion and a lower portion 258*d* serving as a second portion that define a clearance 258*b* therebetween vertically in FIG. 10B. As the cover height adjuster 259 is slidably inserted into the clearance 258*b* horizontally in FIG. 10B in the longitudinal direction of the thermal conduction aid 216, that is, Y-direction, the upper portion 258*c* moves vertically in FIG. 10B to adjust the height of the cover face 258*a*.

A description is provided of a method of producing the clearance 258*b* in the cover 258 vertically in FIG. 10B.

When the cover 258 is molded, a releasable member equivalent to the cover height adjuster 259 is inserted into the cover 258 in advance and pulled out after the cover 258 is molded.

FIG. 10B illustrates the cover 258 in a state in which the cover height adjuster 259 adjusts the height of the cover face 258*a* of the cover 258 such that the cover face 258*a* defines the identical plane with the belt-side face 216*a* of the thermal conduction aid 216 at the lateral end 267 of the thermal conduction aid 216. After the cover height adjuster 259 adjusts the height of the cover face 258*a* of the cover 258, the cover 258 is secured to the base 252 together with the cover height adjuster 259 with an adhesive, a fastener or a securing member such as a screw, or the like at an adjusted position. Accordingly, the cover 258 covers the corner 260 disposed at the lateral edge of the thermal conduction aid 216, precisely preventing the corner 260 from coming into contact with the inner circumferential surface of the fixing belt 201 and damaging the fixing belt 201.

Figure 11A:
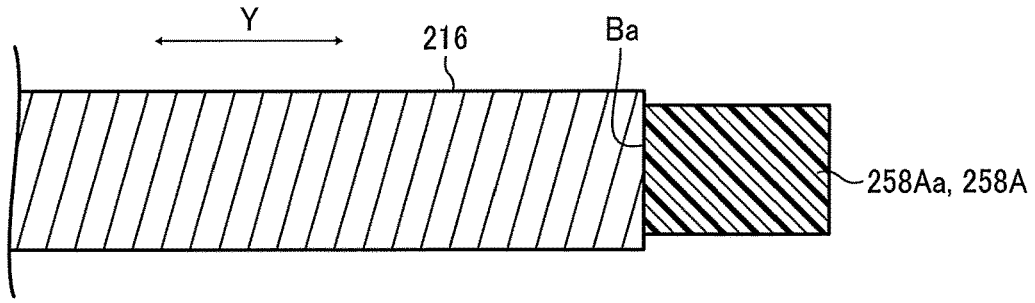
FIG. 11A is a rear view of the thermal conduction aid incorporated in the fixing device depicted in FIG. 2 according to a second embodiment.
Figure 11B:
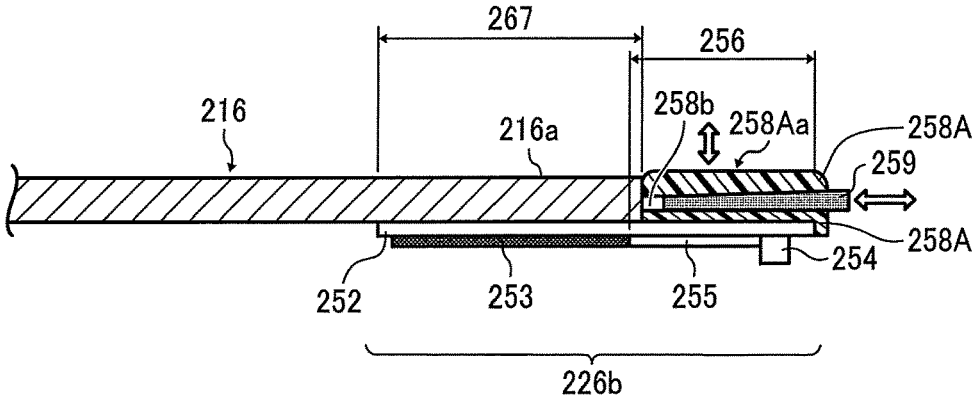
FIG. 11B is a cross-sectional view of the lateral end heater and the thermal conduction aid depicted in FIG. 11A.
Figure 11C:
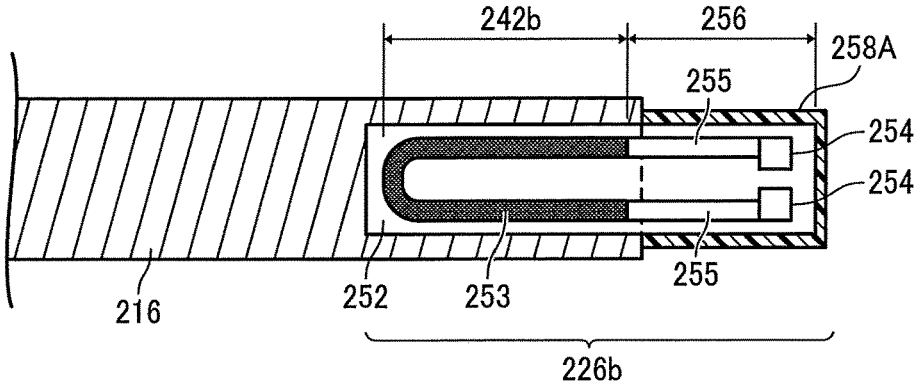
FIG. 11C is a front view of the lateral end heater and the thermal conduction aid depicted in FIG. 11B.

Referring to FIGS. 11A, 11B, and 11C, a description is provided of the construction of the lateral end heaters 226*a* and 226*b* and arrangement of the lateral end heaters 226*a* and 226*b* and the thermal conduction aid 216 according to the second embodiment.

FIGS. 11A, 11B, and 11C illustrate the construction of the lateral end heater 226*b* and arrangement of the lateral end heater 226*b* and the thermal conduction aid 216 according to the second embodiment. FIG. 11A is a rear view of the thermal conduction aid 216 seen from the fixing belt 201 or the fixing nip N depicted in FIG. 2. FIG. 11B is a cross-sectional view of the lateral end heater 226*b* and the thermal conduction aid 216. FIG. 11C is a front view of the lateral end heater 226*b* and the thermal conduction aid 216, seen from the stay 207 depicted in FIG. 2.

The second embodiment illustrated in FIGS. 11A, 11B, and 11C is different from the first embodiment depicted in FIGS. 10A, 10B, and 10C in that the second embodiment incorporates a cover 258A and a cover face 258Aa as described below. As illustrated in FIGS. 11A, 11B, and 11C, the second embodiment employs the cover 258A instead of the cover 258 depicted in FIGS. 10A, 10B, and 10C. As illustrated in FIG. 11B, the cover height adjuster 259 adjusts the cover face 258Aa of the cover 258A to project beyond the belt-side face 216*a* of the lateral end 267 of the thermal conduction aid 216 as a bulge or a projection. A material and a function of the cover 258A are similar to those of the cover 258 according to the first embodiment depicted in FIGS. 10A, 10B, and 10C.

As described above, according to the first embodiment and the second embodiment, the electrodes 254 of the power supply portion 256 are disposed outboard from the lateral end 267 of the thermal conduction aid 216 in the longitudinal direction thereof and spaced apart from the heat generator 242*b* of the lateral end heater 226*b*. Accordingly, heat is not conducted from the heat generator 242*b* to the electrodes 254 of the power supply portion 256 easily, preventing overheating of the power supply portion 256. Consequently, the electrodes 254 of the power supply portion 256 are immune from breakage.

Each of the covers 258 and 258A is made of heat resistant resin, such as LCP, PPS, and PFA, which is softer than the material of the thermal conduction aid 216, that is, metal. Each of the covers 258 and 258A covers the power supply portion 256 and the lateral edge of the thermal conduction aid 216 in the longitudinal direction thereof, preventing the power supply portion 256 and the lateral edge of the thermal conduction aid 216 from coming into contact with the inner circumferential surface of the fixing belt 201. Hence, each of the covers 258 and 258A prevents the inner circumferential surface of the fixing belt 201 from being damaged.

The cover height adjuster 259 adjusts the height of the cover face 258*a* of the cover 258 and the cover face 258Aa of the cover 258A such that the cover face 258*a* defines the identical plane with the belt-side face 216*a* of the thermal conduction aid 216, which is disposed opposite the inner circumferential surface of the fixing belt 201, and the cover face 258Aa projects beyond the belt-side face 216*a* as the bulge or the projection. Accordingly, the cover height adjuster 259 prevents the inner circumferential surface of the fixing belt 201 from being damaged, thus improving the life and durability of the fixing belt 201.

Figure 12A:
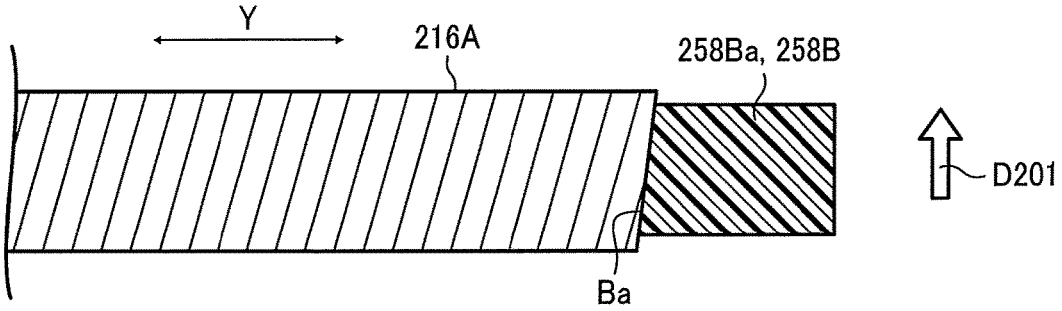
FIG. 12A is a rear view of the thermal conduction aid incorporated in the fixing device depicted in FIG. 2 according to a third embodiment.
Figure 12B:
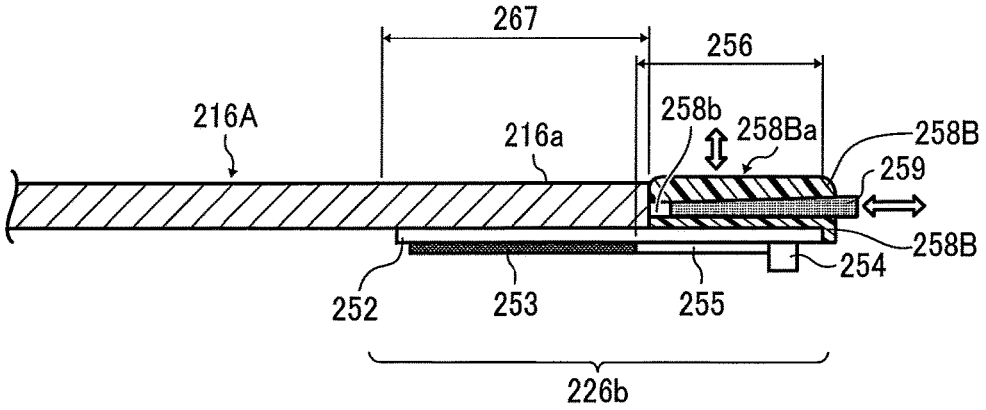
FIG. 12B is a cross-sectional view of the lateral end heater and the thermal conduction aid depicted in FIG. 12A.
Figure 12C:
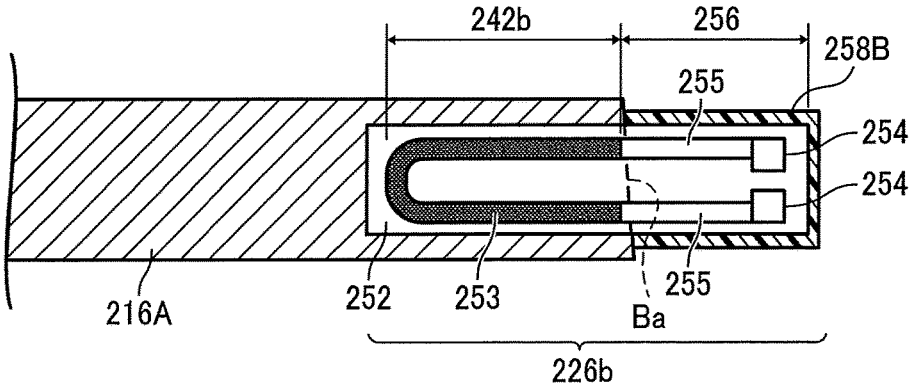
FIG. 12C is a front view of the lateral end heater and the thermal conduction aid depicted in FIG. 12B.

Referring to FIGS. 12A, 12B, and 12C, a description is provided of the construction of the lateral end heaters 226*a* and 226*b* and arrangement of the lateral end heaters 226*a* and 226*b* and a thermal conduction aid 216A according to the third embodiment.

FIGS. 12A, 12B, and 12C illustrate the construction of the lateral end heater 226*b* and arrangement of the lateral end heater 226*b* and the thermal conduction aid 216A according to the third embodiment. FIG. 12A is a rear view of the thermal conduction aid 216A seen from the fixing belt 201 or the fixing nip N depicted in FIG. 2. FIG. 12B is a cross-sectional view of the lateral end heater 226*b* and the thermal conduction aid 216A. FIG. 12C is a front view of the lateral end heater 226*b* and the thermal conduction aid 216A, seen from the stay 207 depicted in FIG. 2.

The third embodiment illustrated in FIGS. 12A, 12B, and 12C is different from the second embodiment depicted in FIGS. 11A, 11B, and 11C in that the third embodiment incorporates the thermal conduction aid 216A, a cover 258B, and a border Ba between the lateral end 267 of the thermal conduction aid 216A and the cover 258B as described below. As illustrated in FIGS. 12A, 12B, and 12C, the third embodiment employs the thermal conduction aid 216A instead of the thermal conduction aid 216 depicted in FIGS. 11A, 11B, and 11C. The third embodiment employs the cover 258B instead of the cover 258A depicted in FIGS. 11A, 11B, and 11C. The border Ba between the lateral end 267 of the thermal conduction aid 216A and the cover 258B is angled relative to the rotation direction D201 of the fixing belt 201. The cover 258B is disposed upstream from the thermal conduction aid 216A in the rotation direction D201 of the fixing belt 201 on the border Ba.

Unlike the thermal conduction aid 216 depicted in FIGS. 11A, 11B, and 11C, the thermal conduction aid 216A is angled relative to the rotation direction D201 of the fixing belt 201. Unlike the cover 258A depicted in FIGS. 11A, 11B, and 11C, the cover 258B is angled relative to the rotation direction D201 of the fixing belt 201.

The border Ba between the lateral end 267 of the thermal conduction aid 216 and the cover 258 according to the first embodiment depicted in FIGS. 10A, 10B, and 10C and the border Ba between the lateral end 267 of the thermal conduction aid 216 and the cover 258A according to the second embodiment depicted in FIGS. 11A, 11B, and 11C are parallel to the rotation direction D201 of the fixing belt 201 and directed in an identical direction with the rotation direction D201 of the fixing belt 201. In this case, the thermal conduction aid 216 and the covers 258 and 258A may scratch the inner circumferential surface of the fixing belt 201 on an identical part of the fixing belt 201, which contacts the border Ba, accelerating damage to the identical part of the fixing belt 201 and shortening the life of the fixing belt 201. To address this circumstance, according to the third embodiment depicted in FIGS. 12A, 12B, and 12C, the border Ba is angled relative to the rotation direction D201 of the fixing belt 201 to prevent the border Ba from being parallel to the rotation direction D201 of the fixing belt 201 and being directed in the identical direction with the rotation direction D201 of the fixing belt 201. Accordingly, a damaged portion of the inner circumferential surface of the fixing belt 201 varies, thus improving the life of the fixing belt 201

As illustrated in FIG. 12B, according to the third embodiment, the cover height adjuster 259 adjusts and retains a cover face 258Ba of the cover 258B to project beyond the belt-side face 216*a* of the thermal conduction aid 216A as a bulge or a projection. The cover 258B is disposed upstream from the thermal conduction aid 216A in the rotation direction D201 of the fixing belt 201 on the border Ba such that the cover face 258Ba of the cover 258B defines a projection and the belt-side face 216*a* of the thermal conduction aid 216A defines a recess adjoining the projection in the rotation direction D201 of the fixing belt 201.

If the cover face 258Ba of the cover 258B and the belt-side face 216*a* of the thermal conduction aid 216A define a recess and a projection adjoining the recess in the rotation direction D201 of the fixing belt 201, respectively, the inner circumferential surface of the fixing belt 201 sliding over the cover 258B and the thermal conduction aid 216A is more susceptible to scratch compared to a case in which the cover face 258Ba of the cover 258B and the belt-side face 216*a* of the thermal conduction aid 216A define a projection and a recess adjoining the projection in the rotation direction D201 of the fixing belt 201, respectively. Hence, the third embodiment improves the life of the fixing belt 201 more than the first embodiment and the second embodiment.

According to the first embodiment depicted in FIG. 10B, the cover face 258*a* of the cover 258 defines the identical plane with the belt-side face 216*a* of the thermal conduction aid 216 at the lateral end 267 of the thermal conduction aid 216. The third embodiment may be applied to the cover 258 and the thermal conduction aid 216 depicted in FIG. 10B. In this case, the border Ba between the lateral end 267 of the thermal conduction aid 216 and the cover 258 is angled relative to the rotation direction D201 of the fixing belt 201. The thermal conduction aid 216 and the cover 258 do not scratch the inner circumferential surface of the fixing belt 201 on the identical part of the fixing belt 201, which contacts the border Ba, improving the life of the fixing belt 201 more than the first embodiment.

The present disclosure is not limited to the details of the embodiments described above and various modifications and improvements are possible. For example, two or more of the first to third embodiments may be combined partially or entirely.

The sheets S serving as recording media on which a toner image is formed are not limited to recording sheets. For example, the sheets S may be thick paper, postcards, envelopes, plain paper, thin paper, coated paper, art paper, tracing paper, and the like. Further, the sheets S may be overhead projector (OHP) transparencies (e.g., a sheet and film), resin film, and other sheets as long as an image is formed thereon.

The fixing device 200 is installed in a color laser printer serving as the image forming apparatus 100 depicted in FIG. 1. Alternatively, the fixing device 200 may be installed in a monochrome image forming apparatus, other image forming apparatuses such as a copier, a facsimile machine, a printer, and a multifunction peripheral or a multifunction printer (MFP), or the like to save energy.

The advantages achieved by the embodiments described above are examples and therefore are not limited to those described above.

A description is provided of advantages of the fixing device 200.

As illustrated in FIGS. 2 and 5, a fixing device (e.g., the fixing device 200) includes a fixing rotator (e.g., the fixing belt 201), an opposed rotator (e.g., the pressure roller 203), a plurality of fixing heaters (e.g. the halogen heaters 202A and 202B), a nip formation pad (e.g., the nip formation pad 206), a plurality of lateral end heaters (e.g., the lateral end heaters 226*a* and 226*b*), and a thermal conduction aid (e.g., the thermal conduction aid 216).

As illustrated in FIG. 2, the fixing rotator is endless, flexible, and rotatable in a rotation direction (e.g., the rotation direction D201). The opposed rotator is outside the fixing rotator and disposed opposite an outer circumferential surface of the fixing rotator. The plurality of fixing heaters having different heat distributions in an axial direction of the fixing rotator, respectively, is disposed inside the fixing rotator and disposed opposite an inner circumferential surface of the fixing rotator. The nip formation pad is disposed inside the fixing rotator and disposed opposite the inner circumferential surface of the fixing rotator. The nip formation pad presses against the opposed rotator via the fixing rotator to form a fixing nip (e.g., the fixing nip N) between the fixing rotator and the opposed rotator, through which a recording medium (e.g., a sheet S) bearing a toner image is conveyed.

As illustrated in FIG. 5, the plurality of lateral end heaters is disposed opposite the inner circumferential surface of the fixing rotator and disposed at both lateral ends of the nip formation pad in a longitudinal direction thereof, respectively. The lateral end heaters heat both lateral ends of the fixing rotator in the axial direction thereof. The thermal conduction aid contacts the fixing rotator and the lateral end heaters to conduct heat in the axial direction of the fixing rotator.

As illustrated in FIGS. 10B, 11B, and 12B, the lateral end heater includes a base (e.g., the base 252), a resistor (e.g., the resistor 253), a power supply portion (e.g., the power supply portion 256) including an electrode (e.g., the electrode 254), and a conductor (e.g., the conductor 255). The fixing device further includes a cover (e.g., the covers 258, 258A, and 258B) and a height adjuster (e.g., the cover height adjuster 259).

The resistor is mounted on the base. The resistor generates heat as the resistor is supplied with power. The electrode is mounted on the base. The electrode supplies power to the resistor. The conductor is mounted on the base. The conductor couples the resistor with the electrode. At least the power supply portion including the electrode is disposed outboard from a lateral end (e.g., the lateral end 267) of the thermal conduction aid in a longitudinal direction thereof. The cover covers the power supply portion disposed opposite the inner circumferential surface of the fixing rotator. The cover includes a cover face (e.g., the cover faces 258*a*, 258Aa, and 258Ba) disposed opposite the inner circumferential surface of the fixing rotator. The thermal conduction aid includes a fixing rotator side face (e.g., the belt-side face 216*a*) disposed opposite the inner circumferential surface of the fixing rotator. The height adjuster adjusts a height of the cover face of the cover such that the height adjuster causes the cover face to define an identical plane with the fixing rotator side face of the thermal conduction aid or causes the cover face to project beyond the fixing rotator side face of the thermal conduction aid.

Accordingly, the fixing device prevents overheating of the power supply portion of the lateral end heater. The cover prevents the inner circumferential surface of the fixing rotator from coming into contact with a lateral edge (e.g., the corner 260) of the thermal conduction aid in the longitudinal direction thereof. The height adjuster causes the cover to cover the lateral edge of the thermal conduction aid in the longitudinal direction thereof, preventing the inner circumferential surface of the fixing rotator from coming into contact with the lateral edge of the thermal conduction aid in the longitudinal direction thereof.

As illustrated in FIG. 6, the fixing device 200 employs a center conveyance system in which the sheet S is centered on the fixing belt 201 in the axial direction thereof Alternatively, the fixing device 200 may employ a lateral end conveyance system in which the sheet S is conveyed in the sheet conveyance direction DS along one lateral end of the fixing belt 201 in the axial direction thereof. In this case, one of the heat generators 202*d* of the halogen heater 202B and one of the lateral end heaters 226*a* and 226*b* are eliminated. Another one of the heat generators 202*d* of the halogen heater 202B and another one of the lateral end heaters 226*a* and 226*b* are distal from the one lateral end of the fixing belt 201 in the axial direction thereof.

According to the embodiments described above, the fixing belt 201 serves as a fixing rotator. Alternatively, a fixing film or the like may be used as a fixing rotator. Further, the pressure roller 203 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing rotator that is endless, flexible, and rotatable in a rotation direction;

an opposed rotator disposed opposite an outer circumferential surface of the fixing rotator;

a thermal conduction aid contacting the fixing rotator to conduct heat in an axial direction of the fixing rotator, the thermal conduction aid including a fixing rotator side face disposed opposite an inner circumferential surface of the fixing rotator;

a lateral end heater, contacting the thermal conduction aid and being disposed opposite a lateral end of the inner circumferential surface of the fixing rotator in the axial direction of the fixing rotator, to heat the fixing rotator, the lateral end heater including a power supply portion disposed outboard from a lateral end of the thermal conduction aid in a longitudinal direction of the thermal conduction aid and disposed opposite the inner circumferential surface of the fixing rotator, the power supply portion including an electrode;

a cover covering the power supply portion, the cover including a cover face disposed opposite the inner circumferential surface of the fixing rotator; and a height adjuster to adjust a height of the cover face of the cover, the height adjuster to cause the cover face to define an identical plane with the fixing rotator side face of the thermal conduction aid.

2. The fixing device according to claim 1, further comprising a nip formation pad disposed opposite the inner circumferential surface of the fixing rotator to form a fixing nip between the fixing rotator and the opposed rotator, the fixing nip through which a recording medium bearing a toner image is conveyed, wherein the lateral end heater is mounted on a lateral end of the nip formation pad in a longitudinal direction of the nip formation pad.

3. The fixing device according to claim 1, further comprising a plurality of fixing heaters being disposed opposite the inner circumferential surface of the fixing rotator and having different heat distributions, respectively, in the axial direction of the fixing rotator.

4. The fixing device according to claim 3, wherein the plurality of fixing heaters includes:

a center heat generator disposed opposite a center span of the fixing rotator in the axial direction of the fixing rotator; and a lateral end heat generator disposed opposite a lateral end span of the fixing rotator in the axial direction of the fixing rotator.

5. The fixing device according to claim 1, wherein the lateral end heater further includes:

a base;

a resistor, mounted on the base, to generate heat as the resistor is supplied with power; and a conductor being mounted on the base and coupling the resistor with the electrode, and wherein the electrode is mounted on the base and supplies power to the resistor.

6. The fixing device according to claim 1, wherein the cover is made of heat resistant resin that is softer than a material of the thermal conduction aid.

7. The fixing device according to claim 1, wherein the height adjuster includes a wedge.

8. The fixing device according to claim 1, wherein the cover further includes:

a first portion; and a second portion defining a clearance with the first portion, and wherein the height adjuster is slidably inserted into the clearance in the longitudinal direction of the thermal conduction aid to move the first portion so as to adjust the height of the cover face of the cover.

9. The fixing device according to claim 1, wherein the cover face of the cover reduces friction between the cover face and the inner circumferential surface of the fixing rotator.

10. A fixing device comprising:

a fixing rotator that is endless, flexible, and rotatable in a rotation direction;

an opposed rotator disposed opposite an outer circumferential surface of the fixing rotator;

a thermal conduction aid contacting the fixing rotator to conduct heat in an axial direction of the fixing rotator, the thermal conduction aid including a fixing rotator side face disposed opposite an inner circumferential surface of the fixing rotator;

a lateral end heater, contacting the thermal conduction aid and being disposed opposite a lateral end of the inner circumferential surface of the fixing rotator in the axial direction of the fixing rotator, to heat the fixing rotator, the lateral end heater including a power supply portion disposed outboard from a lateral end of the thermal conduction aid in a longitudinal direction of the thermal conduction aid and disposed opposite the inner circumferential surface of the fixing rotator, the power supply portion including an electrode;

a cover covering the power supply portion, the cover including a cover face disposed opposite the inner circumferential surface of the fixing rotator; and a height adjuster to adjust a height of the cover face of the cover, the height adjuster to cause the cover face to project beyond the fixing rotator side face of the thermal conduction aid.

11. The fixing device according to claim 10, wherein a border between the lateral end of the thermal conduction aid and the cover is angled relative to the rotation direction of the fixing rotator.

12. The fixing device according to claim 11, wherein the cover is disposed upstream from the thermal conduction aid in the rotation direction of the fixing rotator on the border.

13. The fixing device according to claim 12, wherein the cover face of the cover defines a projection and the fixing rotator side face of the thermal conduction aid defines a recess adjoining the projection in the rotation direction of the fixing rotator.

14. An image forming apparatus comprising:

an image bearer to bear a toner image; and a fixing device to fix the toner image on a recording medium, the fixing device including:

a fixing rotator that is endless, flexible, and rotatable in a rotation direction;

an opposed rotator disposed opposite an outer circumferential surface of the fixing rotator;

a thermal conduction aid contacting the fixing rotator to conduct heat in an axial direction of the fixing rotator, the thermal conduction aid including a fixing rotator side face disposed opposite an inner circumferential surface of the fixing rotator;

a lateral end heater, contacting the thermal conduction aid and being disposed opposite a lateral end of the inner circumferential surface of the fixing rotator in the axial direction of the fixing rotator, to heat the fixing rotator, the lateral end heater including a power supply portion disposed outboard from a lateral end of the thermal conduction aid in a longitudinal direction of the thermal conduction aid and disposed opposite the inner circumferential surface of the fixing rotator, the power supply portion including an electrode;

a cover covering the power supply portion, the cover including a cover face disposed opposite the inner circumferential surface of the fixing rotator; and a height adjuster to adjust a height of the cover face of the cover, the height adjuster to cause the cover face to define an identical plane with the fixing rotator side face of the thermal conduction aid.

* * * * *